US011468824B2

(12) United States Patent
Sun et al.

(10) Patent No.: US 11,468,824 B2
(45) Date of Patent: Oct. 11, 2022

(54) METHODS, CONTROL DEVICES, AND DISPLAY APPARATUS FOR CONTROLLING EDGE DISPLAY OF DISPLAY SCREENS

(71) Applicant: Kunshan Go-Visionox Opto-Electronics Co., Ltd., Kunshan (CN)

(72) Inventors: Jiayao Sun, Kunshan (CN); Zhiheng Yuan, Kunshan (CN)

(73) Assignee: KUNSHAN GO-VISIONOX OPTO-ELECTRONICS CO., LTD., Kunshan (CN)

( * ) Notice: Subject to any disclaimer, the term of this patent is extended or adjusted under 35 U.S.C. 154(b) by 707 days.

(21) Appl. No.: 16/342,525

(22) PCT Filed: Nov. 1, 2018

(86) PCT No.: PCT/CN2018/113503
§ 371 (c)(1),
(2) Date: Apr. 16, 2019

(87) PCT Pub. No.: WO2019/218612
PCT Pub. Date: Nov. 21, 2019

(65) Prior Publication Data

US 2021/0375191 A1 Dec. 2, 2021

(30) Foreign Application Priority Data

May 14, 2018 (CN) ..... 201810456230.7
May 14, 2018 (CN) ..... 201810458113.4

(51) Int. Cl.
*G09G 3/22* (2006.01)

(52) U.S. Cl.
CPC ..... *G09G 3/22* (2013.01); *G09G 2300/0439* (2013.01); *G09G 2310/0232* (2013.01); *G09G 2320/0233* (2013.01); *G09G 2360/16* (2013.01)

(58) Field of Classification Search
CPC ..... G09G 3/22; G09G 2300/0439; G09G 2310/0232; G09G 2320/0233; G09G 2360/16
See application file for complete search history.

(56) References Cited

U.S. PATENT DOCUMENTS

2014/0282283 A1 9/2014 Glebocki
2017/0251086 A1 8/2017 Gagne-Keats et al.
(Continued)

FOREIGN PATENT DOCUMENTS

CN 107526201 A 12/2017
CN 107577078 A 1/2018
(Continued)

OTHER PUBLICATIONS

English Translation of CN 106707606 (Year: 2017).*
English Translation of CN 108538246 (Year: 2018).*
Notice of Allowance of CN Patent Application No. 201810458113.4.

*Primary Examiner* — Patrick N Edouard
*Assistant Examiner* — Eboni N Giles
(74) *Attorney, Agent, or Firm* — Kilpatrick Townsend & Stockton

(57) ABSTRACT

The present disclosure relates to methods, control devices, and display apparatus for controlling edge display of display screens. A method includes: determining an irregular-shaped cutting line cutting at least a part of edge sub-pixels of the display screen, an light-emitting region of each of the edge sub-pixels passed through by the irregular-shaped cutting line being divided into a first region and a second region;
(Continued)

obtaining coordinate values of each vertex of the edge sub-pixel and coordinate values of an intersection point of the edge sub-pixel and the irregular-shaped cutting line, in a two-dimensional coordinate system of a plane of sub-pixels of the display screen; calculating an area ratio coefficient of the edge sub-pixel; obtaining an optimized brightness value less than a preset brightness value of the edge sub-pixel; and causing the edge sub-pixel to display at the optimized brightness value.

15 Claims, 10 Drawing Sheets

(56) References Cited

U.S. PATENT DOCUMENTS

| | | | | |
|---|---|---|---|---|
| 2018/0130397 | A1* | 5/2018 | Zheng | G09G 3/207 |
| 2018/0151612 | A1* | 5/2018 | Zheng | H01L 27/3211 |
| 2018/0166003 | A1 | 6/2018 | Wang et al. | |
| 2018/0211586 | A1 | 7/2018 | Shen et al. | |
| 2019/0096310 | A1* | 3/2019 | Chen | G09G 3/2003 |
| 2020/0402439 | A1* | 12/2020 | Shu | G09G 3/2003 |

FOREIGN PATENT DOCUMENTS

| | | | |
|---|---|---|---|
| CN | 107644410 | A | 1/2018 |
| CN | 107680048 | A | 2/2018 |
| CN | 107924285 | A | 4/2018 |
| CN | 107958919 | A | 4/2018 |
| CN | 108648677 | A | 10/2018 |
| CN | 108665642 | A | 10/2018 |
| GB | 2541730 | B | 3/2017 |
| KR | 20140061064 | A | 5/2014 |

* cited by examiner

METHODS, CONTROL DEVICES, AND DISPLAY APPARATUS FOR CONTROLLING EDGE DISPLAY OF DISPLAY SCREENS

CROSS REFERENCE TO RELATED APPLICATIONS

This application is a national stage for International Application PCT/CN2018/113503, filed on Nov. 1, 2018, which claims the priority benefits of Chinese Patent Application No. 201810458113.4, titled "METHOD FOR CONTROLLING EDGE DISPLAY OF DISPLAY SCREEN, CONTROL DEVICE AND DISPLAY APPARATUS" and filed on Jan. 11, 2018, and Chinese Patent Application No. 201810456230.7, titled "METHOD FOR CONTROLLING EDGE DISPLAY OF DISPLAY SCREEN, CONTROL DEVICE AND DISPLAY APPARATUS" and filed on May 14, 2018. The entireties of these applications are incorporated by reference herein for all purposes.

FIELD

The present disclosure relates to a field of display technologies, and, more particularly, to a method for controlling edge display of a display screen, a control device, and a display apparatus.

BACKGROUND

With the development of display technologies, "full screen" devices are gradually emerging. The "full screen" device refers to a device with a screen ratio closer to 100%. In order to realize display of the full screen, it is inevitable to perform irregular-shaped cutting on a display region of the screen, and the cut edge has an arc-shaped chamfer or a beveled edge. For example, four corners of the screen are chamfered, so that the four corners of the display screen have arc-shaped chamfers. For a mobile phone designed to have a "notch screen", the top of the display screen is slotted to form a notch with two arc-shaped or inclined sides, and the two arc-shaped or inclined sides are connected to each other through a straight line.

The irregular-shaped cut display screen is an irregular-shaped display screen, and a cutting edge line is an irregular-shaped cutting line of the irregular-shaped display screen. Since pixel units in a display region of the display screen is generally arranged in a rectangular array, for a regular-shaped display screen having a rectangular shape as a whole, sub-pixels in the pixel structure are distributed regularly, with flush edges. But for an irregular-shaped display, a design of an arc or a slope of the irregular-shaped cut area causes the sub-pixels to be stepped at the irregular-shaped cutting line, resulting in a significant saw-tooth phenomenon near the irregular-shaped cutting line.

SUMMARY

In view of the above technical problems, it is necessary to provide a method for controlling edge display of a display screen, a control device, and a display apparatus, which are capable of weakening the saw-tooth phenomenon.

According to an aspect of the present disclosure, a method for controlling edge display of a display screen is provided, including:

determining an irregular-shaped cutting line, the irregular-shaped cutting line being located at an irregular-shaped edge of the display screen for defining a theoretical irregular-shaped edge of a display region of the display screen, the irregular-shaped cutting line cutting at least a part of edge sub-pixels of the display screen, a light-emitting region of each of the edge sub-pixels passed through by the irregular-shaped cutting line being divided into a first region located on a side of the irregular-shaped cutting line facing towards the display region of the display screen, and a second region located on another side of the irregular-shaped cutting line facing away from the display region of the display screen;

obtaining coordinate values of each vertex of the edge sub-pixel, and coordinate values of a intersection point of the edge sub-pixel and the irregular-shaped cutting line in a two-dimensional coordinate system of a plane of sub-pixels of the display screen, the coordinate values of the vertex being coordinate values of a common endpoint of adjacent sides of the light-emitting region of the edge sub-pixel;

calculating an area ratio coefficient of each of the edge sub-pixels according to the coordinate values of each vertex and the coordinate values of the intersection point, the area ratio coefficient being a ratio of an area of the first region of the edge sub-pixel to an area of the light-emitting region of the edge sub-pixel;

obtaining an optimized brightness value less than a preset brightness value of the edge sub-pixel according to the area ratio coefficient and the preset brightness value; and causing the edge sub-pixel to display at the optimized brightness value.

In an embodiment, the light-emitting region of the edge sub-pixel is a region corresponding to a light-emitting structure of the edge sub-pixel, and an area of the light-emitting region of the edge sub-pixel is an area of a projection of the light-emitting structure of the edge sub-pixel on an array substrate of the display screen.

In an embodiment, the light-emitting region of the edge sub-pixel is a region corresponding to an overall structure of the edge sub-pixel, and the area of the light-emitting region of the edge sub-pixel is an area of a projection of the overall structure of the edge sub-pixel on an array substrate of the display screen.

In an embodiment, the obtaining the coordinate values of each vertex of the edge sub-pixel, and the coordinate values of the intersection point of the edge sub-pixel and the irregular-shaped cutting line in the two-dimensional coordinate system of the plane of the sub-pixels of the display screen includes:

obtaining the coordinate values of each vertex of the edge sub-pixel in the two-dimensional coordinate system of the plane of the sub-pixels of the display screen, and a curve analytic equation of the irregular-shaped cutting line in the same two-dimensional coordinate system; and calculating the coordinate values of the intersection point of the edge sub-pixel and the irregular-shaped cutting line according to the coordinate values of the vertex and the curve analytic equation.

In an embodiment, the calculating the coordinate values of the intersection point of the edge sub-pixel and the irregular-shaped cutting line according to the coordinate values of the vertex and the curve analytic equation includes:

obtaining an analytic equation of a side of the edge sub-pixel intersecting with the irregular-shaped cutting line according to the coordinate values of the vertex; and establishing and solving an equation set of the curve analytic equation and the analytic equation of the side of the edge sub-pixel intersecting with the irregular-shaped cutting line, to obtain the coordinate values of the intersection point of the edge sub-pixel and the irregular-shaped cutting line.

In an embodiment, the light-emitting region of the edge sub-pixel is a rectangular region defined by four vertices including a first vertex, a second vertex, a third vertex, and a fourth vertex connected sequentially, and the two-dimensional coordinate system of the plane of the sub-pixels of the display screen has a horizontal axis in an extension direction of a side connecting the first vertex and the second vertex, and a vertical axis in an extension direction of a side connecting the first vertex and the fourth vertex;

the coordinate values of the intersection point includes coordinate values of a first intersection point and includes coordinate values of a second intersection point; and the area of the first region is an area of a region in the rectangular region of the edge sub-pixel on a side of a line connecting the first intersection point and the second intersection point facing towards the display region of the display screen.

In an embodiment, the first intersection point is located on a side connecting the first vertex and the fourth vertex, the second intersection point is located on a side connecting the second vertex and the third vertex, the first region is a trapezoidal region defined by the first intersection point, the second intersection point, the third vertex and the fourth vertex, and according to the coordinate values of each vertex and the coordinate values of the intersection points, the area ratio coefficient of the edge sub-pixel is calculated as follows:

$$S'=(|y4-ya|+|y3-yb|)*|x3-x4|/2,$$

$$S=|x2-x1|*|y3-y2|, \text{ and}$$

$$\alpha=S'/S,$$

where x1 is a horizontal coordinate value of the first vertex, x2 is a horizontal coordinate value of the second vertex, x3 is a horizontal coordinate value of the third vertex, x4 is a horizontal coordinate value of the fourth vertex, y2 is a vertical coordinate value of the second vertex, y3 is a vertical coordinate value of the third vertex, y4 is a vertical coordinate value of the fourth vertex, ya is a vertical coordinate value of the first intersection point, yb is a vertical coordinate value of the second intersection point, S' is the area of the first region, S is the area of the light-emitting region, and α is the area ratio coefficient.

In an embodiment, the first intersection point is located on a side connecting the third vertex and the fourth vertex, and the second intersection point is located on the side connecting the second vertex and the third vertex, the first region is a triangular region defined by the first intersection point, the second intersection point, and the third vertex, and according to the coordinate values of each vertex and the coordinate values of the intersection points, the area ratio coefficient of the edge sub-pixel is calculated as follows:

$$S'=|y3-yb|*|x3-xa|/2,$$

$$S=|x2-x1|*|y3-y2|, \text{ and}$$

$$\alpha=S'/S,$$

where x1 is a horizontal coordinate value of the first vertex, x2 is the horizontal coordinate value of the second vertex, x3 is the horizontal coordinate value of the third vertex, y2 is the vertical coordinate value of the second vertex, y3 is the vertical coordinate value of the third vertex, xa is a horizontal coordinate value of the first intersection point, yb is the vertical coordinate value of the second intersection point, S' is the area of the first region, S is the area of the light-emitting region, and α is the area ratio coefficient.

In an embodiment, the first intersection point is located on the side connecting the first vertex and the fourth vertex, the second intersection point is located on a side connecting the first vertex and the second vertex, the first region is a triangular region defined by the first intersection point, the second intersection point, and the first vertex, and according to the coordinate values of each vertex and the coordinate values of the intersection points, the area ratio coefficient of the edge sub-pixel is calculated as follows:

$$S'=|ya-y1|*|xb-x1|/2,$$

$$S=|x2-x1|*|y3-y2|, \text{ and}$$

$$\alpha=S'/S,$$

where x1 is the horizontal coordinate value of the first vertex, x2 is the horizontal coordinate value of the second vertex, y1 is a vertical coordinate value of the first vertex, y2 is the vertical coordinate value of the second vertex, y3 is the vertical coordinate value of the third vertex, ya is the vertical coordinate value of the first intersection point, xb is a horizontal coordinate value of the second intersection point, S' is the area of the first region, S is the area of the light-emitting region, and α is the area ratio coefficient.

In an embodiment, the calculating the area ratio coefficient of the edge sub-pixels according to the coordinate values of each vertex and the coordinate values of the intersection point includes:

calculating an area of the second region and the area of the light-emitting region of the edge sub-pixel according to the coordinate values of each vertex and the coordinate values of the intersection point;

calculating a ratio of the area of the second region to the area of the light-emitting region of the edge sub-pixel; and calculating the area ratio coefficient of the edge sub-pixel according to the ratio of the area of the second region to the area of the light-emitting region of the edge sub-pixel.

In an embodiment, the obtaining the optimized brightness value less than the preset brightness value of the edge sub-pixel according to the area ratio coefficient and the preset brightness value includes:

$$Lnew=\alpha*Lold,$$

where α is the area ratio coefficient, Lold is the preset brightness value, and Lnew is the optimized brightness value.

In an embodiment, the irregular-shaped cutting line is a circular arc cutting line, and the method includes:

obtaining a radius and coordinate values of a center of a circle in the two-dimensional coordinate system of the plane of the sub-pixels of the display screen, the circular arc cutting line being a portion of the circle; and calculating the area ratio coefficient of the edge sub-pixel according to the coordinate values of each vertex, the coordinate values of the center of the circle, and the radius of the circle.

In an embodiment, the light-emitting region of the edge sub-pixel is a region corresponding to a light-emitting structure of the edge sub-pixel, an area of the light-emitting region of the edge sub-pixel is an area of a projection of the light-emitting structure of the edge sub-pixel on an array substrate of the display screen. Alternatively, the light-emitting region of the edge sub-pixel is a region corresponding to an overall structure of the edge sub-pixel, and the area of the light-emitting region of the edge sub-pixel is an area of a projection of the overall structure of the edge sub-pixel on the array substrate of the display screen.

In an embodiment, the light-emitting region of the edge sub-pixel is a rectangular region defined by four vertices including a first vertex farthest from the center of the circle, a second vertex closest to the center of the circle, a third vertex and a fourth vertex, a line connecting the first vertex and the center of the circle is a first radius, a line connecting the second vertex and the center of the circle is a second radius, a line connecting the third vertex and the center of the circle is a third radius, and a line connecting the fourth vertex and the center of the circle is a fourth radius, and an angle between the third radius and the fourth radius is a central angle.

A circle with a radius of the first radius around the center of the circular arc cutting line is an outer circle, a sector of the outer circle corresponding to the central angle is a first sector, a sector of the circle corresponding to the central angle is a second sector, a circle with a radius of second radius around the center of the circular arc cutting line is an inner circle, and a sector of the inner circle corresponding to the central angle is a third sector; and The first region is located on a side of the circular arc cutting line facing towards the center of the circle, the area of the first region is equal to an area of an overlap between the edge sub-pixel and the second sector, and the area of the light-emitting region of the edge sub-pixel is equal to an area of an overlap between the edge sub-pixel and the first sector.

In an embodiment, the calculating the area ratio coefficient of the edge sub-pixel according to the coordinate values of each vertex, the coordinate values of the center of the circle, and the radius of the circle includes:

calculating a distance between the first vertex and the center of the circle based on the coordinate values of the first vertex and the coordinate values of the center of the circle, to obtain a farthest distance, and calculating a distance between the second vertex and the center of the circle based on the coordinate values of the second vertex and the coordinate values of the center of the circle, to obtain a closest distance;

obtaining a first removal area and a second removal area according to the farthest distance, the closest distance, the radius of the circle, and a preset theoretical pixel area, the first removal area is an area of a remaining region obtained by removing the overlap between the edge sub-pixel and the second sector, and removing the third sector from the second sector, and the second removal area is an area of a remaining region obtained by removing a region of the edge sub-pixel outside the second sector, and removing the second sector from the first sector;

calculating the area of the first region according to the radius of the circle, the closest distance, the central angle, and the first removal area;

calculating the area of the light-emitting region of the edge sub-pixel according to the farthest distance, the closest distance, the central angle, the first removal area, and the second removal area; and calculating the ratio of the area of the first region to the area of the light-emitting region of the edge sub-pixel, to obtain the area ratio coefficient of the edge sub-pixel.

In an embodiment, the calculating the area of the first region according to the radius of the circle, the closest distance, the central angle, and the first removal area includes $$A=\pi(R^2-R1^2)*\theta/2\pi-S1,$$

the calculating the area of the light-emitting region of the edge sub-pixel according to the farthest distance, the closest distance, the central angle, the first removal area, and the second removal area includes $$B=\pi(R2^2-R1^2)*\theta/2\pi-S1-S2,$$

where R is the radius of the circle, R1 is the closest distance, R2 is the farthest distance, θ is the central angle, S1 is the first removal area, S2 is the second removal area, A is the area of the first region, and B is the area of the light-emitting region of the edge sub-pixel.

In an embodiment, the obtaining the first removal area and the second removal area according to the farthest distance, the closest distance, the radius of the circle, and the preset theoretical pixel area includes:

$S1$ ranging from $2/8*S0$ to $4/8*S0$, and $S2$ ranging from $4/8*S0$ to $6/8*S0$, if $R1+R2>2R$;

$S1$ ranging from $3/8*S0$ to $5/8*S0$, and $S2$ ranging from $3/8*S0$ to $5/8*S0$, if $R1+R2=2R$; and $S1$ ranging from $4/8*S0$ to $6/8*S0$, and $S2$ ranging from $2/8*S0$ to $4/8*S0$, if $R1+R2<2R$, where S1+S2=S0, R2 is the farthest distance, R1 is the closest distance, R is the radius of the circle, S1 is the first removal area, S2 is the second removal area, and S0 is the theoretical pixel area.

In an embodiment, the obtaining the first removal area and the second removal area according to the farthest distance, the closest distance, the radius of the circle, and the preset theoretical pixel area includes:

$S1=3/8*S0$, and $S2=5/8*S0$, if $R1+R2>2R$;

$S1=S2=1/2*S0$, if $R1+R2=2R$; and $S1=5/8*S0$, and $S2=3/8*S0$, if $R1+R2<2R$.

In an embodiment, the calculating the area ratio coefficient of the edge sub-pixel according to the coordinate values of each vertex, the coordinate values of the center of the circle, and the radius of the circle includes:

calculating an area of the second region and the area of the light-emitting region of the edge sub-pixel according to the coordinate values of each vertex, the coordinate values of the center of the circle, and the radius of the circle;

calculating a ratio of the area of the second region to the area of the light-emitting region of the edge sub-pixel; and calculating the area ratio coefficient of the edge sub-pixel according to the ratio of the area of the second region to the area of the light-emitting region of the edge sub-pixel.

In an embodiment, the obtaining an optimized brightness value less than the preset brightness value of the edge sub-pixel according to the area ratio coefficient and the preset brightness value includes $$Lnew=\alpha*Lold,$$

where α is the area ratio coefficient, Lold is the preset brightness value, and Lnew is the optimized brightness value.

According to another aspect of the present disclosure, a control device is provided, including a processor, and a memory storing a computer program operable to be executed by the processor to cause the processor to perform the method according to the above aspect.

According to a further aspect of the present disclosure, a display apparatus is provided, including a display screen and the control device according to the above aspect, the control device being connected to the display screen.

With the method for controlling edge display of the display screen, the control device and the display screen apparatus described above, the area ratio coefficient may be obtained by calculating the ratio of the area of the first region of the edge sub-pixel to the area of the light-emitting region of the edge sub-pixel, and the optimized brightness value may be obtained according to the area ratio coefficient and the preset brightness value. Since the optimized brightness value is less than the preset brightness value, when the edge sub-pixel displays at the optimized brightness value, the display brightness of the edge sub-pixel can be reduced. In this way, the edge display can be blurred, thereby weakening the edge saw-tooth phenomenon of the edge sub-pixel, and optimizing the display effect of the display screen.

DETAILED DESCRIPTION OF THE INVENTION

Figure 1:
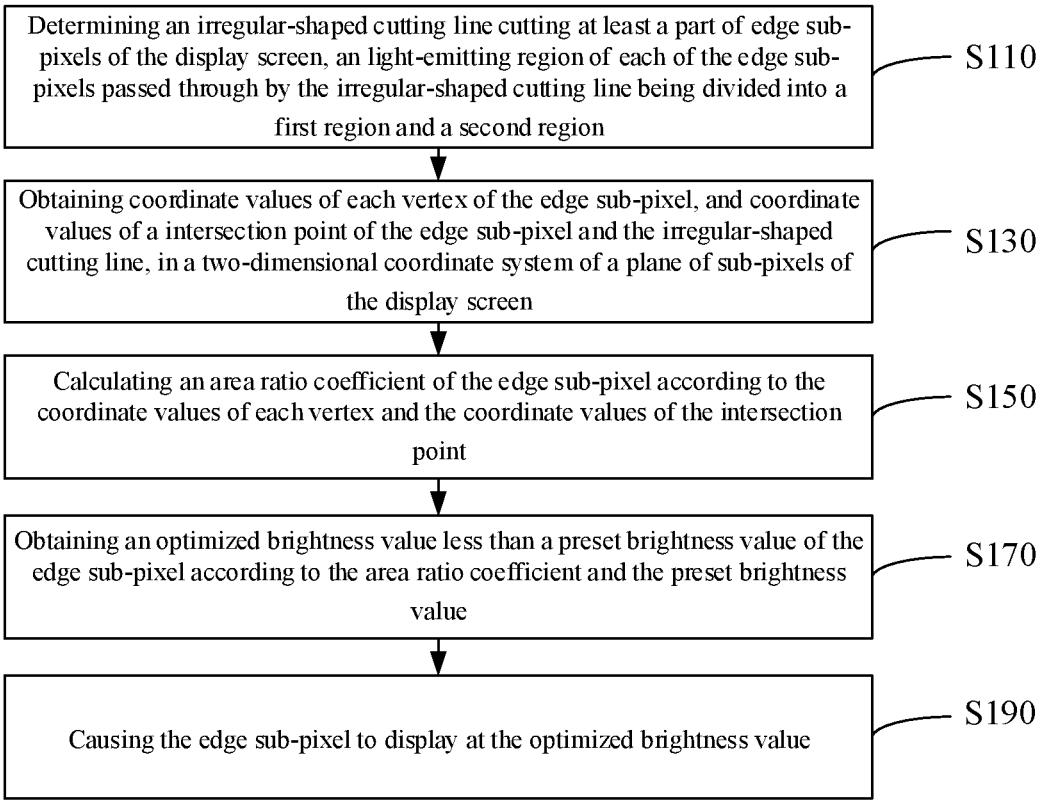
FIG. 1 is a flow diagram illustrating a method for controlling edge display of a display screen according to an embodiment of the present disclosure.

In order to facilitate understanding the present disclosure, the present disclosure will be described in more details hereinafter with reference to the accompanying drawings. Exemplary embodiments of the present disclosure are shown in the drawings. However, the present disclosure can be implemented in many different forms, and is not limited to the embodiments described herein. Rather, these embodiments are presented solely for the purpose of providing thorough and comprehensive understanding of the present disclosure.

In an embodiment, as shown in FIG. 1, a method for controlling edge display of a display screen is provided, which can be applied to a control device. The method includes the following steps.

At S110, an irregular-shaped cutting line cutting at least a part of edge sub-pixels of the display screen is determined. A light-emitting region of each of the edge sub-pixels that are passed through by the irregular-shaped cutting line is divided into a first region and a second region.

The irregular-shaped cutting line is a contour line of the display screen, and is located at an irregular-shaped edge of the display screen for defining a theoretical irregular-shaped edge of the display region of the display screen. The shape of the irregular-shaped cutting line may be pre-designed before chamfering or slotting the display screen. For example, if the chamfer or the slot needs to be arc-shaped, an irregular-shaped cutting line in a shape of a circular arc may be pre-designed. The first region is located on a side of the irregular-shaped cutting line facing towards the display region of the display screen, and the second region is located on another side of the irregular-shaped cutting line facing away from the display region of the display screen.

At S130, coordinate values of each vertex of the edge sub-pixel, and coordinate values of an intersection point of the edge sub-pixel and the irregular-shaped cutting line are obtained in a two-dimensional coordinate system of a plane of sub-pixels of the display screen.

The light-emitting region of the sub-pixel is generally in a shape of a polygon with vertices, such as a rectangle. The coordinate values of the vertex are coordinate values of a common endpoint (vertex) of adjacent sides of the light-emitting region of the edge sub-pixel. If the edge sub-pixel has a plurality of vertices, there are also a plurality of coordinate points corresponding to the plurality of vertices.

Specifically, at the step S130, the coordinate values of each vertex of the edge sub-pixel may be determined based on the established two-dimensional coordinate system, and alternatively the coordinate values of each vertex of the edge sub-pixel may be obtained directly by receiving data input by a user. The coordinate values of the intersection point may be determined according to the coordinate values of the vertex and the irregular-shaped cutting line.

At S150, an area ratio coefficient of the edge sub-pixel is calculated according to the coordinate values of each vertex and the coordinate values of the intersection point.

The area ratio coefficient is a ratio of an area of the first region of the edge sub-pixel to an area of the light-emitting region of the edge sub-pixel. If there are multiple edge sub-pixels cut by the circular arc cutting line, the area ratio coefficient of each edge sub-pixel is calculated according to the coordinate values of the respective vertices and the coordinate values of the respective intersection point.

At S170, an optimized brightness value less than a preset brightness value of the edge sub-pixel is obtained according to the area ratio coefficient and the preset brightness value.

The preset brightness value of the edge sub-pixel is a parameter value corresponding to a brightness of the edge sub-pixel when the edge sub-pixel displays in an ideal case without being cut, and can be preset according to actual conditions. For sub-pixels having a same area of the light-emitting region, the corresponding preset brightness values are equal. Specifically, each of the edge sub-pixels respectively corresponds to one optimized brightness value. If the area ratio coefficient is different, the optimized brightness value is different.

At S190, the edge sub-pixel displays at the optimized brightness value.

The display brightness of the sub-pixel is adjusted and controlled by a magnitude of driving current, and the driving current is output to the sub-pixel from a driving component of the sub-pixel. Specifically, at the step S190, an optimization control signal may be output to the driving component of the edge sub-pixel. The optimization control signal is used to control the magnitude of the driving current output from the driving component. For different optimized brightness values, the optimized control signal controls the driving current output from the driving component to have a different magnitude, so that the display brightness of the edge sub-pixels is different. Specifically, the higher the optimized brightness value, the larger the display brightness of the corresponding edge sub-pixel is.

The above method for controlling edge display of a display screen can be applied to control the edge display of a display screen with an irregular-shaped cutting line. The shape of the irregular-shaped cutting line is not limited to a circular arc, for example, may be a circular arc, an oblique line or other shapes. The area ratio coefficient may be obtained by calculating the ratio of the area of the first region of the edge sub-pixel to the area of the light-emitting region of the edge sub-pixel, and the optimized brightness value may be obtained according to the area ratio coefficient and the preset brightness value. Since the optimized brightness value is less than the preset brightness value, when the edge sub-pixel displays at the optimized brightness value, the display brightness of the edge sub-pixel can be reduced. In this way, the edge display can be blurred, thereby weakening the edge saw-tooth phenomenon of the edge sub-pixel, and optimizing the display effect of the display screen.

The sub-pixel of the display screen includes a TFT (Thin Film Transistor), a wiring region, and a light-emitting structure. In a conventional structure of the display screen, the TFT and the wiring region are covered by an opaque structure layer, and do not allow light pass through them outside the display screen. However, for a display with a fully transparent structure, the TFT and wiring region are also transparent. In an embodiment, the light-emitting region of the edge sub-pixel is a region corresponding to the light-emitting structure of the edge sub-pixel, and an area of the light-emitting region of the edge sub-pixel is an area of a projection of the light-emitting structure of the edge sub-pixel on an array substrate of the display screen.

In another embodiment, when the sub-pixel of the display screen is in a fully transparent structure, the light-emitting region of the edge sub-pixel is the region corresponding to the light-emitting structure of the edge sub-pixel, and the area of the light-emitting region of the edge sub-pixel is the area of the projection of the light-emitting structure of the edge sub-pixel on the array substrate of the display screen. Alternatively, the light-emitting region of the edge sub-pixel is a region corresponding to an overall structure of the edge sub-pixel, and the area of the light-emitting region of the edge sub-pixel is an area of a projection of the overall structure of the edge sub-pixel on the array substrate of the display screen.

In an embodiment, The step S130 includes: obtaining the coordinate values of each vertex of the edge sub-pixel in the two-dimensional coordinate system of the plane of the sub-pixels of the display screen, and a curve analytic equation of the irregular-shaped cutting line in the same two-dimensional coordinate system; and calculating the coordinate values of the intersection point of the edge sub-pixel and the irregular-shaped cutting line according to the coordinate values of the vertex and the curve analytic equation.

Figure 2:
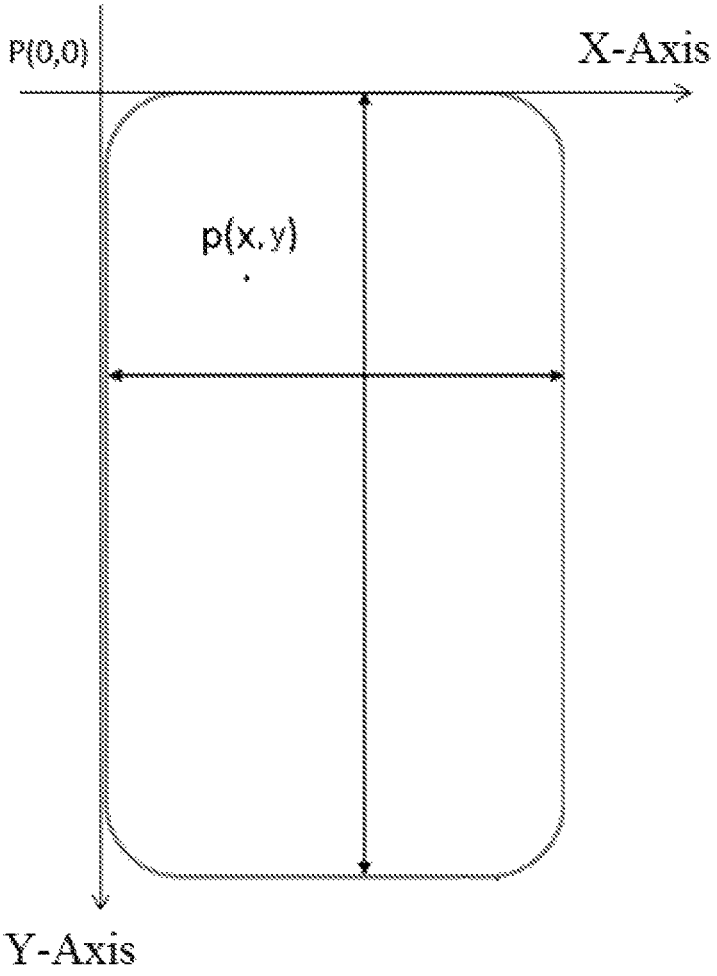
FIG. 2 is a schematic diagram illustrating a display region of a display screen and a two-dimensional coordinate system.

As shown in FIG. 2, the display region of the display screen is equivalent to a two-dimensional coordinate system, and a upper left corner is a coordinate origin P (0, 0), and the entire display region is made of innumerable points. Coordinate values of any point in the display region can be determined, for example, a point p (x, y). Taking a sub-pixel whose light-emitting region is in a shape of a rectangle as an example, the light-emitting region of each sub-pixel can be represented by a closed curve formed by four vertices.

The curve analytic equation is a function expression used to describe a corresponding relationship between the horizontal axis horizontal coordinate value and the vertical axis vertical coordinate value of a point in the curve. The curve analytic equation of the irregular-shaped cutting line is a curve analytic equation corresponding to a curve fitting the irregular-shaped cutting line. Specifically, a curve analytic equation based on a two-dimensional coordinate system of a plane of sub-pixels of the display screen (that is, the curve analytic equation and the coordinate values of the vertex of the edge sub-pixel correspond to a same two-dimensional coordinate system) is stored in advance. Of course, the two-dimensional coordinate system corresponding to the coordinate values of the vertex may be different from the coordinate system corresponding to the curve analysis formula stored in advance, and correspondingly, the curve analytic equation stored in advance is converted into a curve analytic equation in the two-dimensional coordinate system corresponding to the coordinate values of the vertex. According to the curve analytic equation and the coordinate values of the vertex of the edge sub-pixel, the coordinate values of an intersection point corresponding to the intersection position of the edge sub-pixel and the irregular-shaped cutting line are calculated, and the calculation is simple.

Specifically, the arcs of the chamfer and the slot may be fitted to N Bezier curves according to requirements on sizes of the chamfer and the slot, and in combination with an actual size of the display region of the display screen. Accordingly, the curve analytic equation is an analytic equation of the Bezier curve fitting the irregular-shaped cutting line.

In an embodiment, the step of calculating the coordinate values of the intersection point of the edge sub-pixel and the irregular-shaped cutting line according to the coordinate values of the vertex and the curve analytic equation includes: obtaining an analytic equation of a side of the edge sub-pixel intersecting with the irregular-shaped cutting line according to the coordinate values of the vertex; and establishing and solving an equation set of the curve analytic equation and the analytic equation of the side of the edge sub-pixel intersecting with the irregular-shaped cutting line, to obtain the coordinate values of the intersection point of the edge sub-pixel and the irregular-shaped cutting line.

The side of the edge sub-pixel intersecting with the irregular-shaped cutting line has an end point as the vertex of the sub-pixel. Therefore, the coordinate values of the vertex of the edge sub-pixel are known, that is, the coordinate values of the end point of the side intersecting with the irregular-shaped cutting line are known. The analytic equation of the side can be mathematically determined based on the coordinate values of the end point of the side. For example, if the side is a straight line, the analytic equation is: y=kx+b. The coordinate values of the two end points are substituted to y=kx+b to obtain the analytic equation of the side of the edge sub-pixel intersecting with the irregular-shaped cutting line. For example, if the side is a straight line parallel to the x-axis direction, the vertical coordinate values of the two end points are equal, the analytic equation is y=the vertical coordinate values of the two end points, and the limit is that x is greater than or equal to the smaller one of the horizontal coordinate values of two end points, and less than or equal to the larger one of the horizontal coordinate values of the two end points.

After obtaining the curve analytic equation and the analytic equation of the side intersecting with the irregular-shaped cutting line, the equation set is established and solved, to obtain the coordinate values of the intersection point of the curve and the corresponding edge, thereby obtaining the coordinate values of the intersection point of the irregular-shaped cutting line and the edge sub-pixel.

In an embodiment, the light-emitting region of the edge sub-pixel is a rectangular region defined by four vertices including a first vertex, a second vertex, a third vertex, and a fourth vertex connected sequentially. The two-dimensional coordinate system of the plane of the sub-pixels of the display screen has a horizontal axis in an extension direction of a side connecting the first vertex and the second vertex, and a vertical axis in an extension direction of a side connecting the first vertex and the fourth vertex. In this case, the horizontal coordinate values of the first vertex and the fourth vertex are equal, the horizontal coordinate values of the second vertex and the third vertex are equal, the vertical coordinate values of the first vertex and the second vertex are equal, and the vertical coordinate values of the third vertex and the fourth vertex are equal.

The coordinate values of the intersection point includes coordinate values of a first intersection point and comprises coordinate values of a second intersection point. The area of the first region is an area of a region in the rectangular region of the edge sub-pixel on a side of a line connecting the first intersection point and the second intersection point facing towards the display region of the display screen.

Specifically, in different cutting situations, the first region may be a triangular region, a trapezoidal region, or a pentagonal region, depending on the size of the area of the first region.

Specifically, in an embodiment, the first intersection point is located on a side connecting the first vertex and the fourth vertex, the second intersection point is located on a side connecting the second vertex and the third vertex, the first region is a trapezoidal region defined by the first intersection point, the second intersection point, the third vertex and the fourth vertex.

In this embodiment, the step S150 includes:

$$S'=(|y4-ya|+|y3-yb|)*|x3-x4|/2,$$

$$S=|x2-x1|*|y3-y2|, \text{ and}$$

$$\alpha=S'/S,$$

where x1 is a horizontal coordinate value of the first vertex, x2 is a horizontal coordinate value of the second vertex, x3 is a horizontal coordinate value of the third vertex, x4 is a horizontal coordinate value of the fourth vertex, y2 is a vertical coordinate value of the second vertex, y3 is a vertical coordinate value of the third vertex, y4 is a vertical coordinate value of the fourth vertex, ya is a vertical coordinate value of the first intersection point, yb is a vertical coordinate value of the second intersection point, S' is the area of the first region, S is the area of the light-emitting region, and α is the area ratio coefficient.

In this embodiment, a portion of the irregular-shaped cutting line located in the edge sub-pixel is near to a straight line, and the area of the first region is the area of the trapezoid formed by cutting the edge sub-pixel with a straight line. In this case, based on the coordinate values of the intersection points at which the line and the edge sub-pixel intersect and the coordinate values of the vertex of the edge sub-pixel, the area of the trapezoid can be calculated, thereby obtaining the area of the first region. The pixel area of the light-emitting region of the edge sub-pixel can be obtained by calculating the area of the rectangular region of the edge sub-pixel. The calculation is simple, with a small error, and a relatively accurate area ratio coefficient can be obtained, thereby improving the accuracy of the optimized brightness value, and further optimizing the weakening effect on the edge saw-tooth phenomenon.

Figure 3:
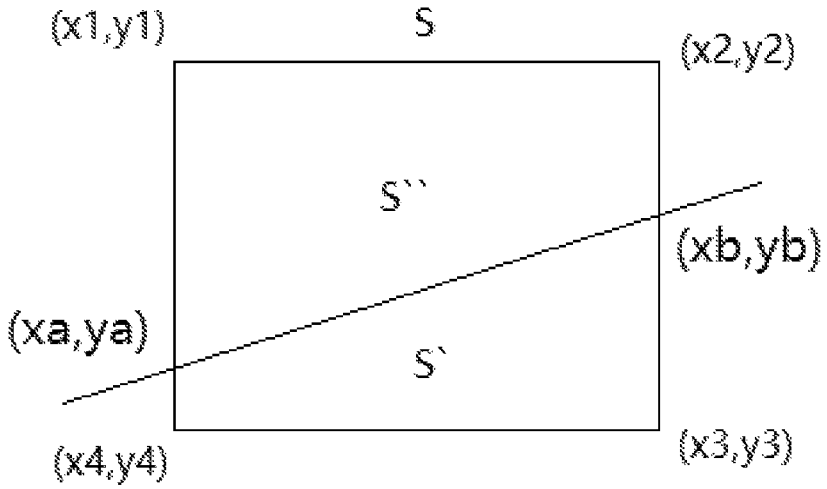
FIG. 3 is a schematic diagram illustrating a positional relationship between an edge sub-pixel and an irregular-shaped cutting line according to an embodiment of the present disclosure.

For example, referring to FIG. 3, the coordinate values of the four vertices of the edge sub-pixel are (x1, y1), (x2, y2), (x3, y3), and (x4, y4). The coordinate values of the first intersection point are (xa, ya), and the coordinate values of the second intersection point are (xb, yb). The first intersection point is located on a line connecting the first vertex (x1, y1) and the fourth vertex (x4, y4), and the second intersection point is located on a line connecting the second vertex (x2, y2) and the third vertex (x3, y3). The irregular-shaped cutting line divides the edge sub-pixel into two regions including a first region and a second region. The first region is defined by four vertices of (xa, ya), (x4, y4), (x3, y3), and (xb, yb), and has an area of S'. The second region is defined by four vertices of (xa, ya), (xb, yb), (x2, y2), and (x1, y1), and has an area of S". The first region and the second region constitute a light-emitting region, and the area of the light-emitting region is S.

Figure 4:
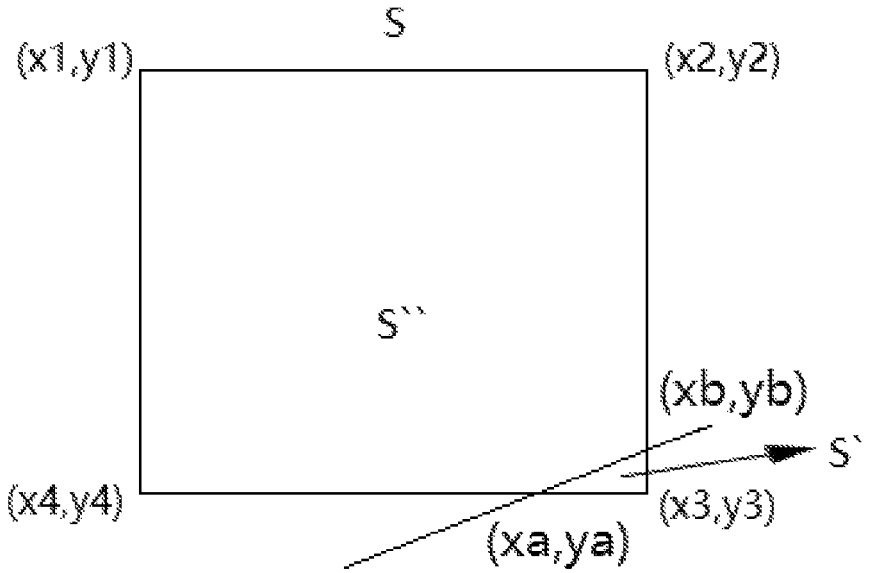
FIG. 4 is a schematic diagram illustrating a positional relationship between an edge sub-pixel and an irregular-shaped cutting line according to another embodiment of the present disclosure.

It can be understood that in other embodiments, other methods may be employed to obtain the area of the first region and the area of the light-emitting region. For example, in another embodiment, referring to FIG. 4, the irregular-shaped cutting line intersects with a side of the edge sub-pixel connecting the third vertex and the fourth vertex, and the coordinate values of the corresponding intersection point are (xa, ya). The irregular-shaped cutting line intersects with a side of the edge sub-pixel connecting the second vertex and the third vertex, and the coordinate values of the corresponding intersection point are (xb, yb). In this embodiment, the area S' of the first region is an area of a triangle defined by the two intersection points and the third vertex, that is, S'=1/2*|y3−yb|*|x3−xa|.

Figure 5:
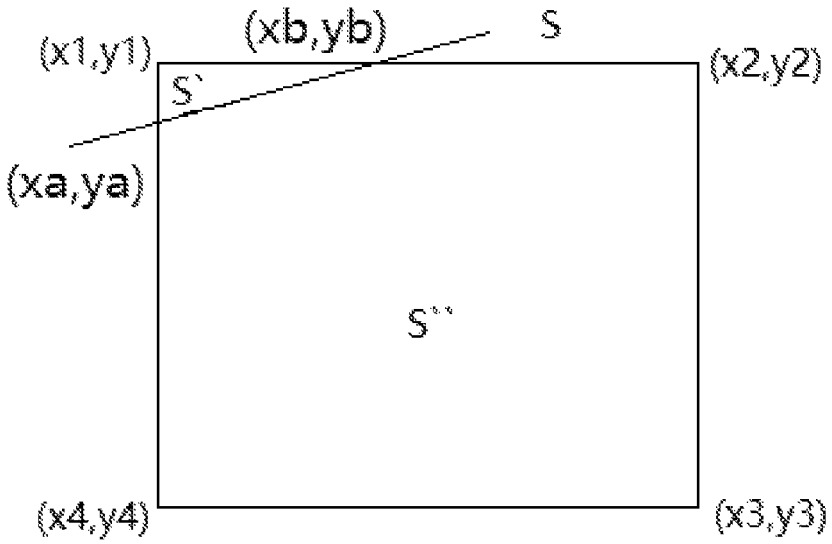
FIG. 5 is a schematic diagram illustrating a positional relationship between an edge sub-pixel and an irregular-shaped cutting line according to another embodiment of the present disclosure.

In a further embodiment, referring to FIG. 5, the irregular-shaped cutting line intersects with a side of the edge sub-pixel connecting the first vertex and the fourth vertex, and the coordinate values of the corresponding intersection point are (xa, ya). The irregular-shaped cutting line intersects with a side of the edge sub-pixel connecting the first vertex and the second vertex, and the coordinate values of the corresponding intersection point are (xb, yb). In this embodiment, the area S' of the first region is an area of the triangle defined by the two intersection points and the first vertex, that is, Y=1/2*|ya−y1|*|xb−x1|.

The calculation of the area ratio coefficient may also employ other methods. For example, in an embodiment, the step S150 includes: calculating an area of the second region and the area of the light-emitting region of the edge sub-pixel according to the coordinate values of each vertex and the coordinate values of the intersection point; calculating a ratio of the area of the second region to the area of the light-emitting region of the edge sub-pixel; and calculating the area ratio coefficient of the edge sub-pixel according to the ratio of the area of the second region to the area of the light-emitting region of the edge sub-pixel. Specifically, by subtracting the ratio of the area of the second region to the area of the light-emitting region of the edge sub-pixel from one, the area ratio coefficient of the edge sub-pixel can be obtained.

Figure 6:
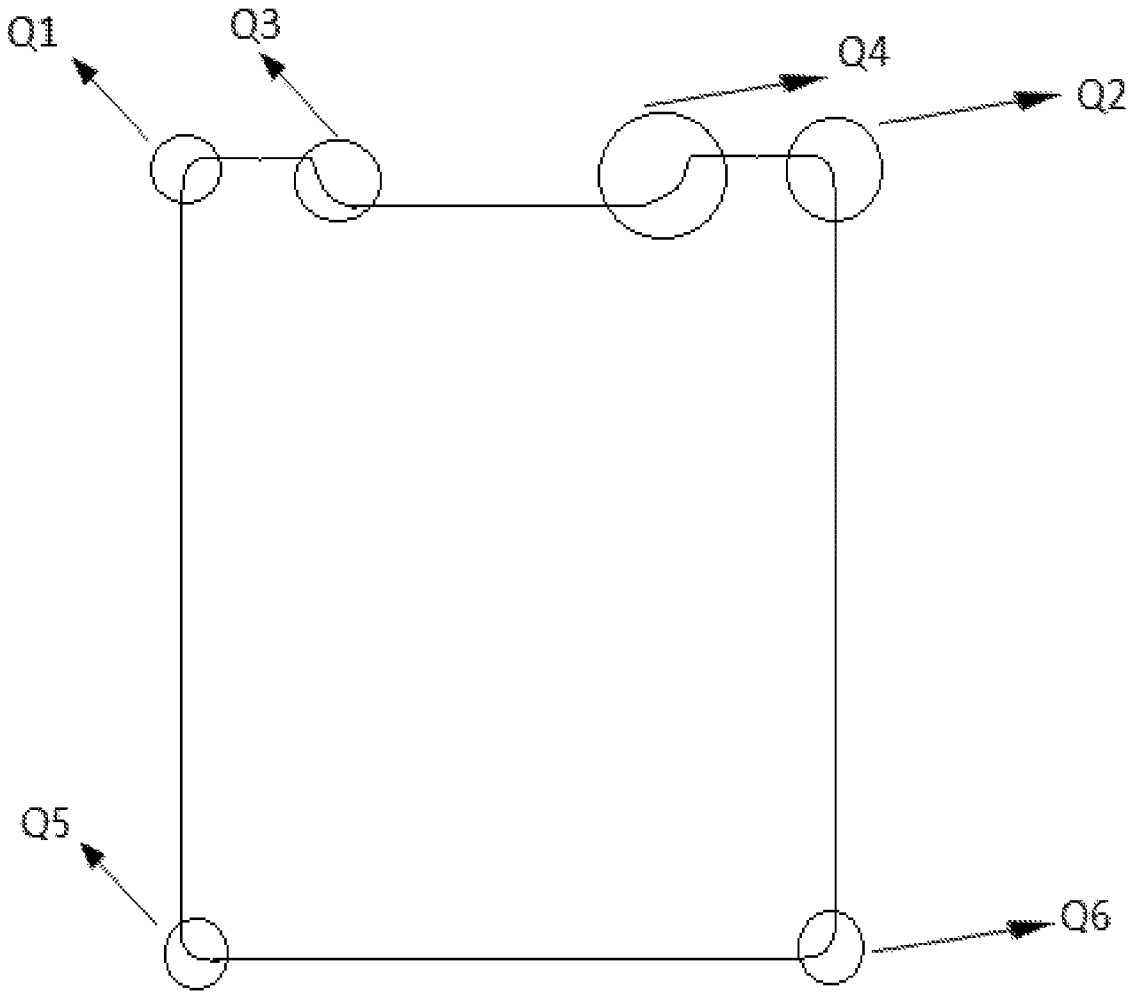
FIG. 6 is a schematic diagram illustrating an irregular-shaped cutting line in a display screen.

For example, referring to FIG. 6, the display screen panel is chamfered and slotted. The slotted portion of the display screen is the top of the display screen, the end opposite to the top of the display screen is the bottom, a direction facing towards the top and facing away from the bottom is an upward direction, and a direction facing towards the bottom and facing away from the top is a downward direction. For Q1, Q2, Q3 and Q4, the first region is located below the edge sub-pixel, and the area of the first region may be obtained by calculating an area of a lower region of the divided edge sub-pixel. The area ratio coefficient may be obtained by calculating the ratio of the area of the first region to the area of the light-emitting region. For Q5 and Q6, the first region is located above the edge sub-pixel, and the second region is located below the edge sub-pixel. The area of the second region may be obtained by calculating an area of a lower region of the divided edge sub-pixel. The area ratio coefficient is calculated to be obtained by subtracting the ratio of the area of the second region to the area of the light-emitting region of the edge sub-pixel from one.

In an embodiment, the step S170 includes:

$$Lnew=\alpha*Lold,$$

where $\alpha$ is the area ratio coefficient, Lold is the preset brightness value, and Lnew is the optimized brightness value.

By multiplying the preset brightness value by an area ratio coefficient which is less than 1, the preset brightness value is adjusted, and the obtained optimized brightness value is less than the preset brightness value, so that the edge sub-pixel displays at the optimized brightness value, and the brightness is lowered. In this way, the edge display can be blurred, the edge saw-tooth phenomenon of the edge sub-pixel can be weakened, and the display effect of the display screen can be optimized.

In an embodiment, the above method for controlling edge display of a display screen further includes: causing the sub-pixels not cut by the irregular-shaped cutting line to display at the preset brightness value.

Taking the Bezier curve fitting the irregular-shaped cutting line as an example to illustrate, when the Bezier curve is mapped to the two-dimensional coordinate system, there will be two situations of tracks of the Bezier curve in the two-dimensional coordinate system as follows.

a. The curve track does not pass through an closed region of any one of the sub-pixels.

b. The curve track passes through a closed region of the edge sub-pixel.

If the closed region of the sub-pixel is not passed though by the Bezier curve, the sub-pixel may display at a brightness corresponding to the preset brightness value. If the closed region of the edge sub-pixel is passed through by the Bezier curve, the edge sub-pixel may display at a brightness corresponding to the optimized brightness value.

Specifically, a control signal may be output to a driving component of a sub-pixel which is not cut by the irregular-shaped cutting line, and the control signal is used to control the magnitude of the driving current output from the driving component.

Figure 7:
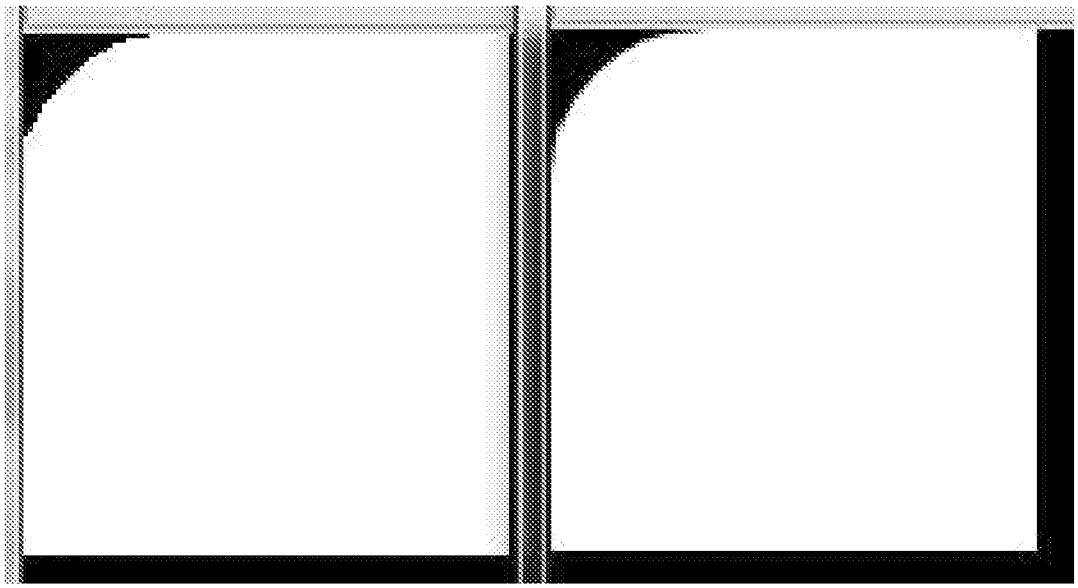
FIG. 7 is a comparison diagram of the effects of edge display without or with a method for controlling edge display of a display screen according to the present disclosure.

The effect diagrams of an application are described as follows. As shown in FIG. 7, on the left side is a rounded edge displayed without the above method for controlling the edge display of the display screen, and a sharp jagged edge is visible. On the right side is a display effect when displayed in the above method for controlling the edge display of the display screen, and there is no visible saw-tooth. It can be seen that the above method for controlling the edge display of the display screen can effectively reduce the edge saw-tooth phenomenon of the edge sub-pixels and optimize the display effect of the display screen.

Figure 8:
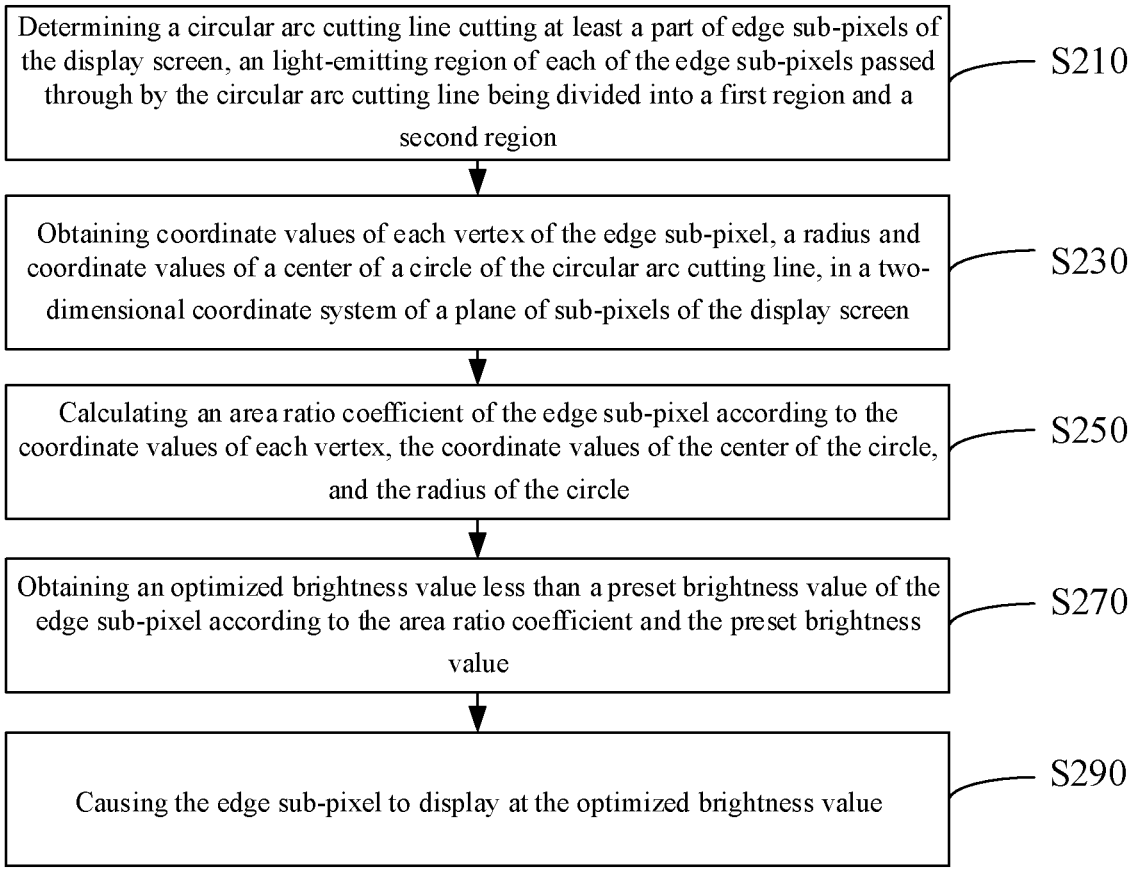
FIG. 8 is a flow diagram illustrating a method for controlling edge display of a display screen according to another embodiment of the present disclosure.

FIG. 8 illustrates a flow diagram illustrating a method for controlling edge display of a display screen according to another embodiment of the present disclosure. As shown in FIG. 8, the method includes the following steps.

At S210, a circular arc cutting line cutting at least a part of edge sub-pixels of the display screen is determined, and a light-emitting region of each edge sub-pixel passed through by the circular arc cutting line is divided into a first region and a second region.

The circular arc cutting line is a contour line of the display screen, and is located at a circular arc edge of the display screen for defining a theoretical circular arc edge of the display region of the display screen. The shape of the cutting line may be pre-designed before chamfering or slotting the display screen. For example, if the chamfer or the slot needs to be arc-shaped, a circular arc cutting line may be preset. The first region is located on a side of the circular arc cutting line facing towards the display region of the display screen, and the second region is located on another side of the circular arc cutting line facing away from the display region of the display screen.

At S230, coordinate values of each vertex of the edge sub-pixel, a radius of a circle where the circular arc cutting line is located, and coordinate values of a center of the circle are obtained in a two-dimensional coordinate system of a plane of sub-pixels of the display screen.

The light-emitting structure of the sub-pixel is generally in a shape of a polygon with vertices, such as a rectangle. The coordinate values of the vertex are coordinate values of a common endpoint of adjacent sides of the light-emitting region of the edge sub-pixel. If the edge sub-pixel has a plurality of vertices, there are also a plurality of coordinate points corresponding to the plurality of vertices. Since the circular arc is a portion of a circle between two points, one circular arc corresponds to one circle, that is, the radius and the center of the circle can be determined according to the circular arc. Therefore, based on the circular arc cutting line, the radius and center of the circle where the circular arc cutting line is located can be determined.

The coordinate values of the center are the coordinate values of the center of the circle where the circular arc cutting line is located.

Specifically, at step S230, both the coordinate values of the vertex of the edge sub-pixel and the radius and the coordinate values of the center of the center of the circle where the circular arc cutting line is located may be determined based on the same two-dimensional coordinate system established. Alternatively, the coordinate values of the vertex of the edge sub-pixel and the radius and the coordinate values of the center of the circle where the circular arc cutting line is located may be obtained directly by receiving data input by a user.

S250: an area ratio coefficient of the edge sub-pixel is calculated according to the coordinate values of each vertex, the coordinate values of the center and the radius of the circle where the circular arc cutting line is located.

The area ratio coefficient is a ratio of an area of the first region of the edge sub-pixel to an area of the light-emitting region of the edge sub-pixel. If there are multiple edge sub-pixels cut by the circular arc cutting line, the area ratio coefficient of each edge sub-pixel is obtained according to the radius of the circle where the circular arc cutting line is located and the coordinate values of each vertex of the edge sub-pixel.

At S270, an optimized brightness value less than a preset brightness value of the edge sub-pixel is obtained according to the area ratio coefficient and the preset brightness value.

The preset brightness value of the edge sub-pixel is a parameter value corresponding to a brightness of the edge sub-pixel when the edge sub-pixel displays in an ideal case without being cut, and can be preset according to actual conditions. For sub-pixels having a same area of the light-emitting region, the corresponding preset brightness values are equal. Specifically, each of the edge sub-pixels respectively corresponds to one optimized brightness value. If the area ratio coefficient is different, the optimized brightness value is different.

At S290, the edge sub-pixel displays at the optimized brightness value.

The display brightness of the sub-pixel is adjusted and controlled by a magnitude of driving current, and the driving current is output to the sub-pixel from a driving component of the sub-pixel. Specifically, at the step S290, an optimization control signal may be output to the driving component of the edge sub-pixel. The optimization control signal is used to control the magnitude of the driving current output from the driving component. For different optimized brightness values, the optimized control signal controls the driving current output from the driving component to have a different magnitude, so that the display brightness of the edge sub-pixels is different. Specifically, the higher the optimized brightness value, the larger the display brightness of the corresponding edge sub-pixel is.

The above method for controlling edge display of a display screen can be applied to control the edge display of a display screen with a circular arc cutting line. The area ratio coefficient may be obtained by calculating the ratio of the area of the first region of the edge sub-pixel to the area of the light-emitting region of the edge sub-pixel, and the optimized brightness value may be obtained according to the area ratio coefficient and the preset brightness value. Since the optimized brightness value is less than the preset brightness value, when the edge sub-pixel displays at the optimized brightness value, the display brightness of the edge sub-pixel can be reduced. In this way, the edge display can be blurred, thereby weakening the edge saw-tooth phenomenon of the edge sub-pixel, and optimizing the display effect of the display screen.

The sub-pixel of the display screen includes a TFT, a wiring region, and a light-emitting structure. In a conventional structure of the display screen, the TFT and the wiring region are covered by an opaque structure layer, and do not allow light pass through them outside the display screen. However, for a display with a fully transparent structure, the TFT and the wiring region are also transparent. In an embodiment, the light-emitting region of the edge sub-pixel is a region corresponding to the light-emitting structure of the edge sub-pixel, and an area of the light-emitting region of the edge sub-pixel is an area of a projection of the light-emitting structure of the edge sub-pixel on an array substrate of the display screen.

In another embodiment, when the sub-pixel of the display screen is in a fully transparent structure, the light-emitting region of the edge sub-pixel is the region corresponding to the light-emitting structure of the edge sub-pixel, and the area of the light-emitting region of the edge sub-pixel is the area of the projection of the light-emitting structure of the edge sub-pixel on the array substrate of the display screen. Alternatively, the light-emitting region of the edge sub-pixel is a region corresponding to an overall structure of the edge sub-pixel, and the area of the light-emitting region of the edge sub-pixel is an area of a projection of the overall structure of the edge sub-pixel on the array substrate of the display screen.

In an embodiment, the light-emitting region of the edge sub-pixel is a rectangular region defined by four vertices a first vertex farthest from the center of the circle, a second vertex closest to the center of the circle, a third vertex and a fourth vertex. A line connecting the first vertex and the center of the circle is a first radius, a line connecting the second vertex and the center of the circle is a second radius, a line connecting the third vertex and the center of the circle is a third radius, and a line connecting the fourth vertex and the center of the circle is a fourth radius. An angle between the third radius and the fourth radius is a central angle. A circle with a radius of the first radius around the center of the circular arc cutting line is an outer circle, a sector of the outer circle corresponding to the central angle is a first sector, a sector of the circle corresponding to the central angle is a second sector, a circle with a radius of second radius around the center of the circular arc cutting line is an inner circle, and a sector of the inner circle corresponding to the central angle is a third sector. That is, the first sector has an area larger than that of the second sector, and the second sector has an area larger than that of the third sector.

In this embodiment, the first region of the edge sub-pixel is located on a side of the circular arc cutting line facing towards the center of the circle. The area of the first region is equal to the area of an overlap between the edge sub-pixel and the second sector. The area of the light-emitting region of the edge sub-pixel is equal to an area of the overlap between the edge sub-pixel and the first sector.

Figure 9:
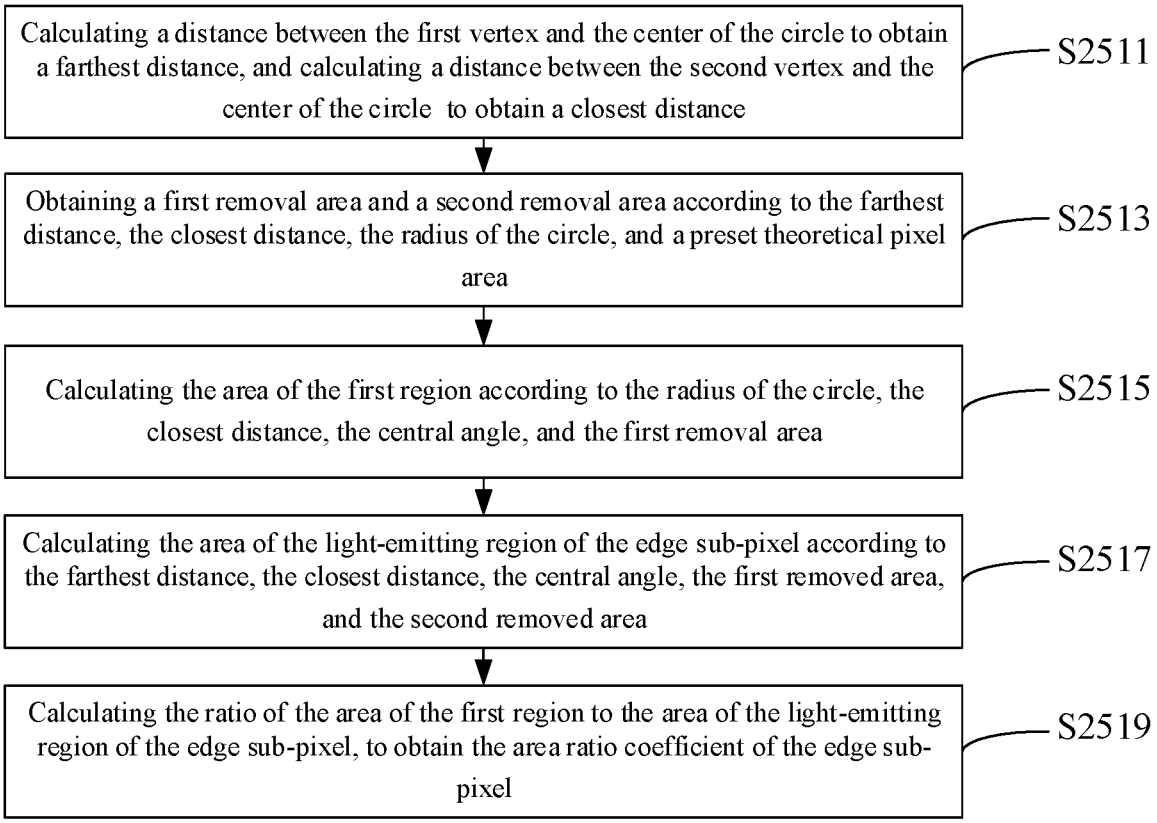
FIG. 9 is a flow diagram illustrating processes of calculating an area ratio coefficient of an edge sub-pixel based on the coordinate values of each vertex, the coordinate values of a center of a circle where the circular arc cutting line is located, and a radius of the circle, according to an embodiment of the present disclosure.

In an embodiment, referring to FIG. 9, the step S250 includes steps S2511 to S2519.

At S2511, a distance between the first vertex and the center of the circle is calculated based on the coordinate values of the first vertex and the coordinate values of the center of the circle, to obtain a farthest distance, and a distance between the second vertex and the center of the circle is calculated based on the coordinate values of the second vertex and the coordinate values of the center of the circle, to obtain a closest distance.

Specifically, if the coordinate values of the center of the circle and the coordinate values of the first vertex and the second vertex are determined based on a same two-dimensional coordinate system, the farthest distance can be directly calculated according to the coordinate values of the first vertex and the coordinate values of the center of the circle, the closest distance can be directly calculated according to the coordinate values of the second vertex and the coordinate values of the center of the circle. If the coordinate values of the center of the circle and the coordinate values of the first vertex and the second vertex are not determined based on a same two-dimensional coordinate system, the coordinate values of the first vertex, the coordinate values of the second vertex, and the coordinate values of the center of the circle should be converted into coordinate values in a same two-dimensional coordinate system, and then the farthest distance and the closest distance is calculated.

At S2513, a first removal area and a second removal area is obtained according to the farthest distance, the closest distance, the radius of the circle where the circular arc cutting line is located, and the preset theoretical pixel area.

The first removal area is an area of a remaining region obtained by removing the overlap between the edge sub-pixel and the second sector, and removing the third sector from the second sector, and the second removal area is an area of a remaining region obtained by removing a region of the edge sub-pixel outside the second sector, and removing the second sector from the first sector. The theoretical pixel area is an area of the light-emitting region of the edge sub-pixel without being cut. For example, if the edge sub-pixel is in a shape of a square, the theoretical pixel area is the square of the side length of the edge sub-pixel. If the edge sub-pixel is in a shape of a rectangular, the theoretical pixel area is the product of the length and the width of the edge sub-pixel.

Figure 10:
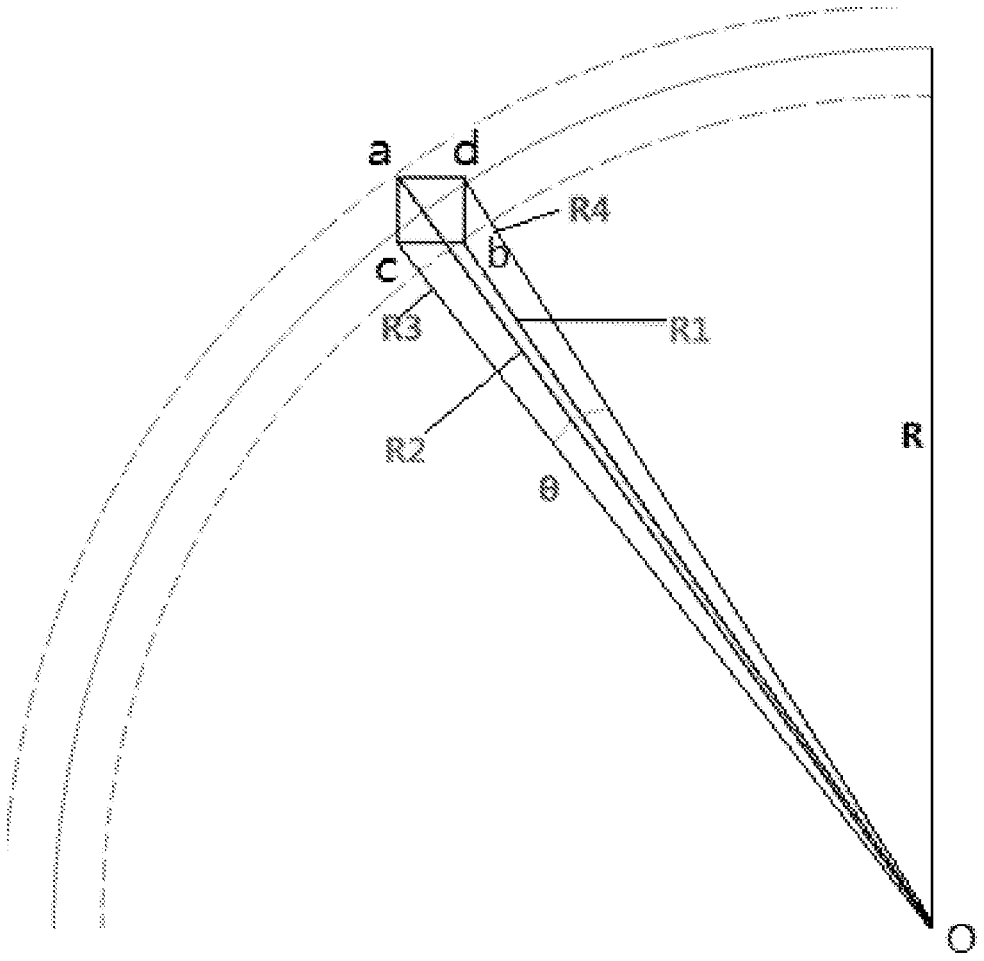
FIG. 10 is a schematic diagram illustrating positional relationships between an edge sub-pixel and a circular arc cutting line, and between the edge sub-pixel and a center of the circle according to an embodiment of the present disclosure.
Figure 11:
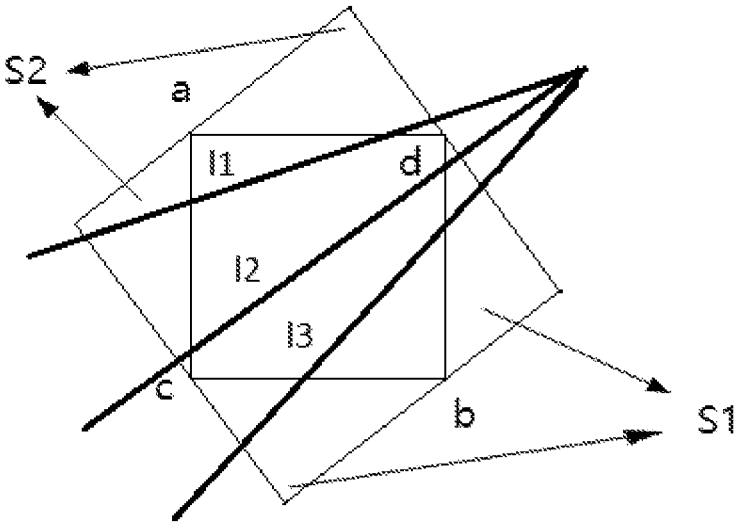
FIG. 11 is a partial enlarged view of FIG. 10.

For example, taking an embodiment as an example, referring to FIG. 10 and FIG. 11, the edge sub-pixel is in a shape of a rectangle with a first vertex a, a second vertex b, a third vertex c, and a fourth vertex d. As shown in FIG. 10, a solid line having two intersection points with the edge sub-pixel in three curves is the circular arc cutting line. The center of the circle where the circular arc cutting line is located is defined as a coordinate origin O, and a two-dimensional coordinate system is established. R is the radius of the circle corresponding to the circular arc cutting line. R1 is the closest distance, and R2 is the farthest distance. R3 is a distance from c to the center of the circle, and R4 is a distance from d to the center of the circle. θ is the central angle. As shown in FIG. 11, the approximate straight line l3 of the circular arc cutting line is taken as an example. The sum of the areas of two polygons corresponding to two arrows pointing to S1 is the first removal area. Taking the approximate straight line l1 of the circular arc cutting line as an example, the sum of the areas of two polygons corresponding to two arrows pointing to S2 is a second removal area.

At S2515, the area of the first region is calculated according to the radius of the circle where the circular arc cutting line is located, the closest distance, the central angle, and the first removal area.

At S2517, the area of the light-emitting region of the edge sub-pixel is calculated according to the farthest distance, the closest distance, the central angle, the first removal area, and the second removal area.

At S2519, the ratio of the area of the first region to the area of the light-emitting region of the edge sub-pixel is calculated, to obtain the area ratio coefficient of the edge sub-pixel.

The area ratio coefficient can be obtained according to the ratio of the area of the first region located on the side of the circular arc cutting line facing towards the center of the circle to the area of the light-emitting region of the edge sub-pixel, and the area ratio coefficient can represent the area occupied by a portion of the edge sub-pixel located in the display region. If the area ratio coefficient is different, the optimized brightness value is different. The brightness of the edge sub-pixel display is adjusted depending on the area of the portion of the edge sub-pixel located in the display region, and the edge display has a good blur effect. Thus, the edge saw-tooth phenomenon is reduced significantly.

In an embodiment, the step S2513 includes:

if R1+R2>2R, S1 ranging from 2/8*S0 to 4/8*S0, and S2 ranging from 4/8*S0 to 6/8*S0, both including endpoint values;

if R1+R2=2R, S1 ranging from 3/8*S0 to 5/8*S0, and S2 ranging from 3/8*S0 to 5/8*S0, both including endpoint values; and if R1+R2<2R, S1 ranging from 4/8*S0 to 6/8*S0, and S2 ranging from 2/8*S0 to 4/8*S0, both including endpoint values, where S1+S2=S0, R2 is the farthest distance, R1 is the closest distance, R is the radius of the circle where the circular arc cutting line is located, S1 is the first removal area, S2 is the second removal area, and S0 is the theoretical pixel area. Specifically, $R2=\sqrt{x^2+y^2}$, $R1=\sqrt{x_0^2+y_0^2}$, where x and y are a horizontal coordinate value and a vertical coordinate value of the first vertex with respect to the center of the circle, respectively, and $x_0$ and $y_0$ are a horizontal coordinate value and a vertical coordinate value of the second vertex with respect to the center of the circle, respectively.

Depending on the different situations where the edge sub-pixel is cut by the circular arc cutting line, the values of the first removal area and the second removal area are different. Through research and analysis on a variety of different cutting situations, and multiple analysis and verification for the variety of different situations, the following rules are found. If the sum of the farthest distance and the closest distance is greater than twice the radius of the circle where the circular arc cutting line is located, the first removal area fluctuates up and down at 3/8*S0, and the error range is 1/8*S0, that is, the first removal area may be any value between 2/8*S0 and 4/8*S0, including values of 2/8*S0 and 4/8*S0. Correspondingly, the second removal area fluctuates up and down at 5/8*S0, and the error range is 1/8*S0, that is, the second removal area may be any value between 4/8*S0 and 6/8*S0, including values of 4/8*S0 and 6/8*S0, as long as S1+S2=S0 is satisfied.

If the sum of the farthest distance and the closest distance is equal to twice the radius of the circle where the circular arc cutting line is located, the first removal area and the second removal area fluctuate up and down at 1/2*S0, and the error range is 1/8*S, that is, the first removal area and the second removal area may be any value between 3/8*S0 and 5/8*S0, including two values of 3/8*S0 and 5/8*S0, as long as S1+S2=S0 is satisfied.

If the sum of the farthest distance and the closest distance is less than twice the radius of the circle where the circular arc cutting line is located, the first removal area fluctuates up and down at 5/8*S0, and the error range is 1/8*S0, that is, the first removal area may be any value between 4/8*S0 and 6/8*S0, including two values of 4/8*S0 and 6/8*S0. Correspondingly, the second removal area fluctuates up and down at 3/8*S0, the error range is 1/8*S0, that is, the second removal area may be any value between 2/8*S0 and 4/8*S0, including two values of 2/8*S0 and 4/8*S0, as long as S1+S2=S0 is satisfied.

By comparing the sum of the farthest distance and the closest distance with twice the radius of the circle where the circular arc cutting line is located, and determining the value of the first removal area and the value of the second removal area according to the result of the comparison, a method for determining the values of the first removal area and the second removal area is provided. Since the values of the first removal area and the second removal area vary with different situations, the accuracy of determining the values may be high by analyzing different situations, thereby increasing the accuracy of the area ratio coefficient and the optimized brightness value, and optimizing the weakening effect on the edge saw-tooth phenomenon. For example, referring to FIG.

11, the approximate straight lines of the circular arc cutting lines are l1, l2, and l3 in three situations. l3 corresponds to a situation where R1+R2>2R, l2 corresponds to a situation where R1+R2=2R, and l1 corresponds to a situation where R1+R2.<2R In an embodiment, specifically, the step S2513 includes:

if $R1+R2>2R$, $S1=3/8*S0$, and $S2=5/8*S0$;

if $R1+R2=2R$, $S1=S2=1/2*S0$; and if $R1+R2<2R$, $S1=5/8*S0$, $S2=3/8*S0$.

The study result indicated that: if the sum of the farthest distance and the closest distance is greater than twice the radius of the circle where the circular arc cutting line is located, when the first removal area is 3/8*S0, and the second removal area is 5/8*S0, the calculated area ratio coefficient error is small; if the sum of the farthest distance and the closest distance is equal to twice the radius of the circle where the circular arc cutting line is located, when each of the first removal area and the second removal area is 1/2*S0, the calculated area ratio coefficient error is small; and if the sum of the farthest distance and the closest distance is less than twice the radius of the circle where the circular arc cutting line is located, when the first removal area is 5/8*S0, and the second removal area is 3/8*S0, the calculated area ratio coefficient error is small.

It should be noted that, during the process of calculation, the light-emitting region of the each sub-pixel is calculated as it has a shape approximate to a rectangular, and the first region and the second region of each sub-pixel are calculated as they have a shape approximate to a polygon. Such approximate relationships will inevitably lead to a small error of the result, which is within the range allowed by the visual perception of human eyes, that is to say, the equivalence relationship in this embodiment is approximately equivalence in a mathematical sense.

In an embodiment, at the step S2515, specifically the area of the second sector and the area of the third sector are calculated based on the radius of the circle where the circular arc cutting line is located, the closest distance, and the central angle, and the area of the first region are calculated by subtracting the area of the third sector and the first removal area from the area of the second sector. At the step S2517, specifically the area of the first sector and the area of the third sector are calculated based on the farthest distance, the closest distance, and the central angle, and the area of the light-emitting region of the edge sub-pixel is calculated by subtracting the area of the third sector, the first removal area and the second removal area from the area of the first sector.

Specifically, the step S2515 includes $$A=\pi(R^2-R1^2)*\theta/2\pi-S1, \text{ and}$$

the step S2517 includes $$B=\pi(R2^2-R1^2)*\theta/2\pi-S1-S2,$$

where R is the radius of the circle where the circular arc cutting line is located, R1 is the closest distance, R2 is the farthest distance, θ is the central angle, S1 is the first removal area, S2 is the second removal area, A is the area of the first region, and B is the area of the light-emitting region of the edge sub-pixel.

The area of the first region is obtained by subtracting the excess area (the first removal area) from the calculated sector area, and the light-emitting region is obtained by subtracting the excess area (the first removal area and the second removal area) from the calculated sector area. This calculation can have a small error, and a relatively accurate area ratio coefficient can be obtained, thereby improving the accuracy of the optimized brightness value, and further optimizing the weakening effect on the edge saw-tooth phenomenon.

It can be understood that in other embodiments, other methods may be employed to obtain the area of the first region and the area of the light-emitting region of the edge sub-pixel. For example, the coordinate values of the intersection point of the circular arc cutting line and the edge sub-pixel can be obtained, and the area of the first region can be calculated according to the coordinate values of the intersection point and the coordinate values of the vertex by a geometric algorithm. For example, the theoretical pixel area of the edge sub-pixel can be directly used as the light-emitting region.

In another embodiment, the step S250 includes: calculating an area of the second region and the area of the light-emitting region of the edge sub-pixel according to the coordinate values of each vertex, the coordinate values of the center of the circle, and the radius of the circle; calculating a ratio of the area of the second region to the area of the light-emitting region of the edge sub-pixel; and calculating the area ratio coefficient of the edge sub-pixel according to the ratio of the area of the second region to the area of the light-emitting region of the edge sub-pixel. Specifically, by subtracting the ratio of the area of the second region to the area of the light-emitting region of the edge sub-pixel from one, the area ratio coefficient of the edge sub-pixel may be obtained.

Figure 12:
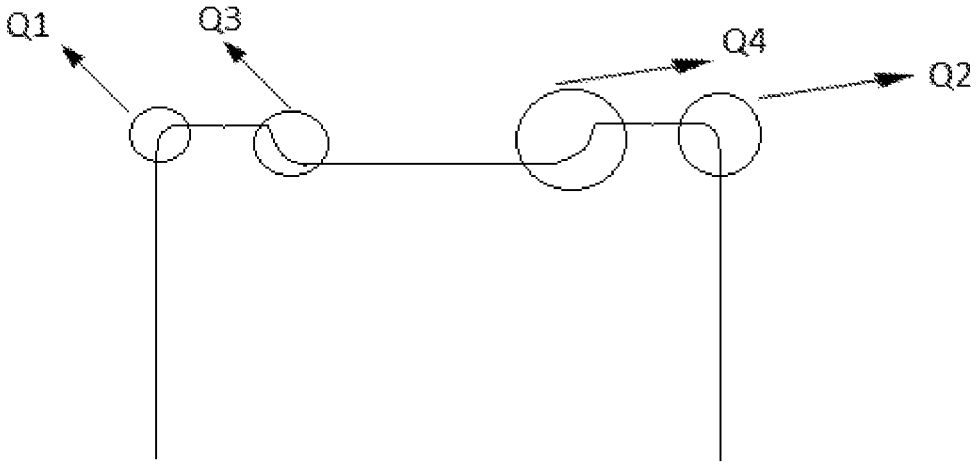
FIG. 12 is a schematic diagram illustrating a part of circular arc cutting lines in the display screen.

For example, referring to FIG. 12, the display screen is chamfered and slotted. For Q1 and Q2, the first region is located on the side of the circular arc cutting line facing towards the center of the circle, and the area of the first region is calculated by subtracting the area of the third sector and the first removal area from the area of the second sector. The area ratio coefficient is obtained by calculating a ratio of the area of the first region to the area of the light-emitting region of the edge sub-pixel. For Q3 and Q4, the first region is located on the side of the circular arc cutting line facing away from the center of the circle, and the second region is located on the side of the circular arc cutting line facing towards the center of the circle. The area of the second region is calculated by subtracting the area of the third sector and the second removal area from the area of the second sector. The area ratio coefficient is calculated by subtracting the ratio of the area of the second region to the area of the light-emitting region of the edge sub-pixel from one.

In an embodiment, the step S270 includes:

$$Lnew=\alpha*Lold,$$

where α is the area ratio coefficient, Lold is the preset brightness value, and Lnew is the optimized brightness value.

By multiplying the preset brightness value by an area ratio coefficient which is less than 1, the preset brightness value is adjusted, and the obtained optimized brightness value is less than the preset brightness value, so that the edge sub-pixel displays at the optimized brightness value, and the brightness is lowered. In this way, the edge display can be blurred, the edge saw-tooth phenomenon of the edge sub-pixel can be weakened, and the display effect of the display screen can be optimized.

By using the above method for controlling edge display of a display screen, a display effect similar to that shown on the right side of FIG. 7 can be achieved, and basically no obvious saw-tooth can be seen. Therefore, the above method for controlling edge display of a display screen can also effectively reduce the edge saw-tooth phenomenon of the edge sub-pixels and optimize the display screen effect of the display screen.

It should be understood that although the various steps in the flow diagrams of FIG. 1 and FIG. 8-9 show in a sequence as indicated by arrows, the steps are not necessary to be executed in the sequence as indicated by the arrows. Unless specifically illustrated in the text, there are no strict restrictions to the order for executing these steps, and they can be executed in other orders. Further, at least some of the steps in FIG. 1 and FIG. 8-9 can include multiple sub-steps or multiple phases. The sub-steps and the phases are not necessary to be executed simultaneously, and can be executed during different times, and the order is not necessary to be performed one by one, and can be executed alternatively or in a turn with a least a part of the sub-steps of the other step or the other phases.

Moreover, a person of ordinary skill in the art can understand that in the actual calculation process of a computer, the above brightness adjustment process for the edge sub-pixel is performed in parallel for all edge sub-pixels simultaneously, and in the embodiment described above, the calculation process is described only from the perspective of a single edge sub-pixel.

Figure 13:
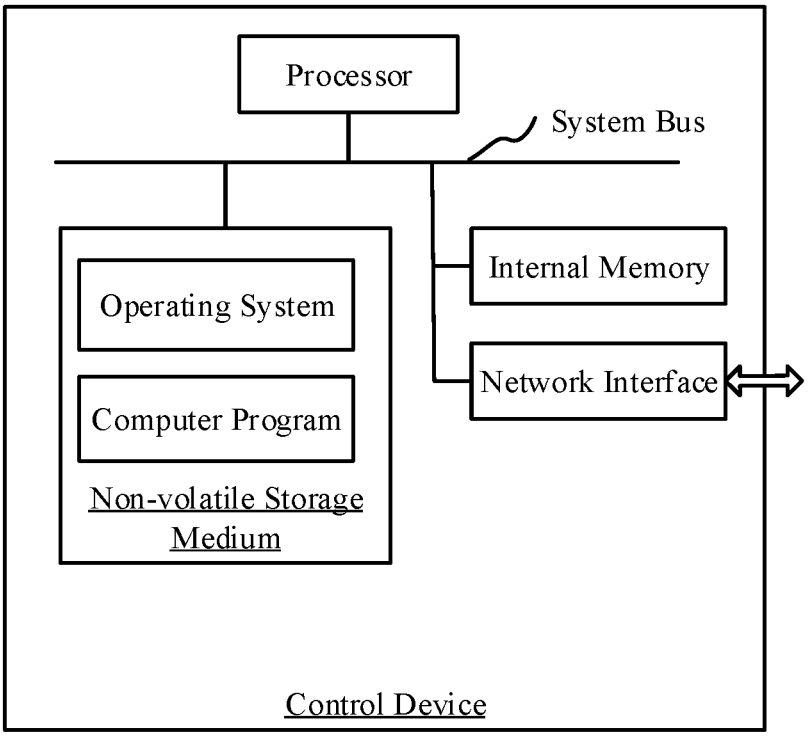
FIG. 13 is a schematic diagram illustrating an internal configuration of a control device according to an embodiment of the present disclosure.

The present disclosure also provides a control device, an internal configuration of which is shown in FIG. 13. The control device includes a processor, a memory, and a network interface connected by a system bus. The processor of the control device is used to provide computing and control capabilities. The memory of the control device includes a non-volatile storage medium and an internal memory. The non-volatile storage medium stores an operating system and a computer program. The internal memory provides an environment for operation of the operating system and the computer program stored in the non-volatile storage medium. The network interface of the control device is used to communicate with an external terminal via a network connection. The computer program is executed by the processor to perform a method for controlling edge display of a display screen.

It should be understood by a person of ordinary skill in the art that the configuration shown in FIG. 13 is only a block diagram of a part of the configuration related to the solution of the present disclosure, and does not constitute a limitation to the control device to which the solution of the present disclosure is applied. The specific control device may include more or fewer components than those shown in the drawings, alternatively some components can be combined, or they may have different component arrangements.

In an embodiment, a control device is provided, including a processor, and a memory storing a computer program operable to be executed by the processor to cause the processor to perform the following steps:

determining an irregular-shaped cutting line cutting at least a part of edge sub-pixels of the display screen, an light-emitting region of each of the edge sub-pixels passed through by the irregular-shaped cutting line being divided into a first region and a second region; obtaining coordinate values of each vertex of the edge sub-pixel, and coordinate values of a intersection point of the edge sub-pixel and the irregular-shaped cutting line, in a two-dimensional coordinate system of a plane of sub-pixels of the display screen; calculating an area ratio coefficient of the edge sub-pixel according to the coordinate values of each vertex and the coordinate values of the intersection point; obtaining an optimized brightness value less than a preset brightness value of the edge sub-pixel according to the area ratio coefficient and the preset brightness value; and causing the edge sub-pixel to display at the optimized brightness value.

The irregular-shaped cutting line is located at an irregular-shaped edge of the display screen for defining a theoretical irregular-shaped edge of a display region of the display screen. The first region is located on a side of the irregular-shaped cutting line facing towards the display region, and the second region is located on another side of the irregular-shaped cutting line facing away from the display region of the display screen. The coordinate values of the vertex are coordinate values of a common endpoint of adjacent sides of the light-emitting region of the edge sub-pixel. The area ratio coefficient is a ratio of an area of the first region of the edge sub-pixel to an area of the light-emitting region of the edge sub-pixel.

The above control device can be applied to control the edge display of a display screen with an irregular-shaped cutting line. The shape of the irregular-shaped cutting line is not limited to a circular arc, for example, may be a circular arc, an oblique line or other shapes. The area ratio coefficient may be obtained by calculating the ratio of the area of the first region of the edge sub-pixel to the area of the light-emitting region of the edge sub-pixel, and the optimized brightness value may be obtained according to the area ratio coefficient and the preset brightness value. Since the optimized brightness value is less than the preset brightness value, when the edge sub-pixel displays at the optimized brightness value, the display brightness of the edge sub-pixel can be reduced. In this way, the edge display can be blurred, thereby weakening the edge saw-tooth phenomenon of the edge sub-pixel, and optimizing the display effect of the display screen.

In an embodiment, the light-emitting region of the edge sub-pixel is a region corresponding to a light-emitting structure of the edge sub-pixel, and an area of the light-emitting region of the edge sub-pixel is an area of a projection of the light-emitting structure of the edge sub-pixel on an array substrate of the display screen.

In another embodiment, when the sub-pixel of the display screen is in a fully transparent structure, the light-emitting region of the edge sub-pixel is the region corresponding to the light-emitting structure of the edge sub-pixel, and the area of the light-emitting region of the edge sub-pixel is the area of the projection of the light-emitting structure of the edge sub-pixel on the array substrate of the display screen. Alternatively, the light-emitting region of the edge sub-pixel is a region corresponding to an overall structure of the edge sub-pixel, and the area of the light-emitting region of the edge sub-pixel is an area of a projection of the overall structure of the edge sub-pixel on the array substrate of the display screen.

In an embodiment, when the computer program is executed by the processor, the processor is caused to perform the following steps: obtaining the coordinate values of each vertex of the edge sub-pixel in the two-dimensional coordinate system of the plane of the sub-pixels of the display screen, and a curve analytic equation of the irregular-shaped cutting line in the same two-dimensional coordinate system; and calculating the coordinate values of the intersection point of the edge sub-pixel and the irregular-shaped cutting line according to the coordinate values of the vertex and the curve analytic equation.

According to the curve analytic equation and the coordinate values of the vertex of the edge sub-pixel, the coordinate values of an intersection point corresponding to the intersection position of the edge sub-pixel and the irregular-shaped cutting line are calculated, and the calculation is simple.

In an embodiment, when the computer program is executed by the processor, the step of calculating the coordinate values of the intersection point of the edge sub-pixel and the irregular-shaped cutting line according to the coordinate values of the vertex and the curve analytic equation performed by the processor includes: obtaining an analytic equation of a side of the edge sub-pixel intersecting with the irregular-shaped cutting line according to the coordinate values of the vertex; and establishing and solving an equation set of the curve analytic equation and the analytic equation of the side of the edge sub-pixel intersecting with the irregular-shaped cutting line, to obtain the coordinate values of the intersection point of the edge sub-pixel and the irregular-shaped cutting line.

In an embodiment, the light-emitting region of the edge sub-pixel is a rectangular region defined by four vertices comprising a first vertex, a second vertex, a third vertex, and a fourth vertex connected sequentially, and the two-dimensional coordinate system of the plane of the sub-pixels of the display screen has a horizontal axis in an extension direction of a side connecting the first vertex and the second vertex, and a vertical axis in an extension direction of a side connecting the first vertex and the fourth vertex. In this case, the horizontal coordinate values of the first vertex and the fourth vertex are equal, the horizontal coordinate values of the second vertex and the third vertex are equal, the vertical coordinate values of the first vertex and the second vertex are equal, and the vertical coordinate values of the third vertex and the fourth vertex are equal.

The coordinate values of the intersection point include coordinate values of a first intersection point and coordinate values of a second intersection point. The area of the first region is an area of a region in the rectangular region of the edge sub-pixel on a side of a line connecting the first intersection point and the second intersection point facing towards the display region of the display screen.

Specifically, in different cutting situations, the first region may be a triangular region, a trapezoidal region, or a pentagonal region, depending on the size of the area of the first region.

Specifically, in an embodiment, the first intersection point is located on a side connecting the first vertex and the fourth vertex, the second intersection point is located on a side connecting the second vertex and the third vertex, the first region is a trapezoidal region defined by the first intersection point, the second intersection point, the third vertex and the fourth vertex. In this embodiment, when the computer program is executed by the processor, the step of calculating the area ratio coefficient of the edge sub-pixel according to the coordinate values of each vertex and the coordinate values of the intersection points performed by the processor includes:

$$S'=(|y4-ya|+|y3-yb|)*|x3-x4|/2,$$

$$S=|x2-x1|*|y3-y2|, \text{ and}$$

$$\alpha=S'/S,$$

where x1 is a horizontal coordinate value of the first vertex, x2 is a horizontal coordinate value of the second vertex, x3 is a horizontal coordinate value of the third vertex, x4 is a horizontal coordinate value of the fourth vertex, y2 is a vertical coordinate value of the second vertex, y3 is a vertical coordinate value of the third vertex, y4 is a vertical coordinate value of the fourth vertex, ya is a vertical coordinate value of the first intersection point, yb is a vertical coordinate value of the second intersection point, S' is the area of the first region, S is the area of the light-emitting region, and α is the area ratio coefficient By fitting a portion of the irregular-shaped cutting line located in the edge sub-pixel to a straight line, the area of the first region is the area of the trapezoid formed by cutting the edge sub-pixel with a straight line. In this case, based on the coordinate values of the intersection points at which the line and the edge sub-pixel intersect and the coordinate values of the vertex of the edge sub-pixel, the area of the trapezoid can be calculated, thereby obtaining the area of the first region. The pixel area of the light-emitting region of the edge sub-pixel can be obtained by calculating the area of the rectangular region of the edge sub-pixel. The calculation is simple, with a small error, and a relatively accurate area ratio coefficient can be obtained, thereby improving the accuracy of optimizing the brightness value, and further optimizing the weakening effect on the edge saw-tooth phenomenon.

It can be understood that in other embodiments, other methods may be employed to obtain the area of the first region and the area of the light-emitting region. For example, in another embodiment, referring to FIG. 4, when the computer program is executed by the processor, the processor is caused to perform a calculation: $S'=1/2*|y3-yb|*|x3-xa|$, to obtain the area of the first region. In another embodiment, referring to FIG. 5, when the computer program is executed by the processor, the processor is caused to perform a calculation: $S'=1/2*|ya-y1|*|xb-x1|$, to obtain the area of the first region.

In an embodiment, when the computer program is executed by the processor, the step of calculating the area ratio coefficient of the edge sub-pixel according to the coordinate values of each vertex and the coordinate values of the intersection points performed by the processor includes: calculating an area of the second region and the area of the light-emitting region of the edge sub-pixel according to the coordinate values of each vertex and the coordinate values of the intersection point; calculating a ratio of the area of the second region to the area of the light-emitting region of the edge sub-pixel; and calculating the area ratio coefficient of the edge sub-pixel according to the ratio of the area of the second region to the area of the light-emitting region of the edge sub-pixel. Specifically, by subtracting the ratio of the area of the second region to the area of the light-emitting region of the edge sub-pixel from one, the area ratio coefficient of the edge sub-pixel can be obtained.

In an embodiment, when the computer program is executed by the processor, the step of obtaining the optimized brightness value less than the preset brightness value of the edge sub-pixel according to the area ratio coefficient and the preset brightness value includes:

$$L\text{new}=\alpha*L\text{old},$$

where α is the area ratio coefficient, Lold is the preset brightness value, and Lnew is the optimized brightness value.

By multiplying the preset brightness value by an area ratio coefficient which is less than 1, the preset brightness value is adjusted, and the obtained optimized brightness value is less than the preset brightness value, so that the edge sub-pixel displays at the optimized brightness value, and the brightness is lowered. In this way, the edge display can be blurred, the edge saw-tooth phenomenon of the edge sub-pixel can be weakened, and the display effect of the display screen can be optimized.

In an embodiment, when the computer program is executed by the processor, the processor is also caused to perform the following step: causing the sub-pixels not cut by the irregular-shaped cutting line to display at the preset brightness value. Specifically, a control signal may be output to a driving component of a sub-pixel which is not cut by the irregular-shaped cutting line, and the control signal is used to control the magnitude of the driving current output from the driving component.

The present disclosure also provides another control device, including a processor, and a memory storing a computer program operable to be executed by the processor to cause the processor to perform the following steps: determining a circular arc cutting line cutting at least a part of edge sub-pixels of the display screen, a light-emitting region of each edge sub-pixel passed through by the circular arc cutting line being divided into a first region and a second region; obtaining coordinate values of each vertex of the edge sub-pixel, a radius of a circle where the circular arc cutting line is located, and coordinate values of a center of the circle in a two-dimensional coordinate system of a plane of sub-pixels of the display screen; calculating an area ratio coefficient of the edge sub-pixel according to the coordinate values of each vertex, the coordinate values of the center of the circle where the circular arc cutting line is located, and the radius of the circle where the circular arc cutting line is located; obtaining an optimized brightness value less than a preset brightness value of the edge sub-pixel according to the area ratio coefficient and the preset brightness value; and causing the edge sub-pixel to displays at the optimized brightness value.

The circular arc cutting line is located at a circular arc edge of the display screen, and is used to define the theoretical arc edge of the display region of the display screen. The first region is located on a side of the circular arc cutting line facing towards the display region of the display screen, and the second region is located on another side of the circular arc cutting line facing away from the display region of the display screen. The coordinate values of the vertex are the coordinate values of a common endpoint of adjacent sides of the light-emitting region of the edge sub-pixel. The area ratio coefficient is a ratio of an area of the first region of the edge sub-pixel to an area of the light-emitting region of the edge sub-pixel.

The control device may be applied to control edge display of a display screen with a circular arc cutting line. The area ratio coefficient may be obtained by calculating the ratio of the area of the first region of the edge sub-pixel to the area of the light-emitting region of the edge sub-pixel, and the optimized brightness value may be obtained according to the area ratio coefficient and the preset brightness value. Since the optimized brightness value is less than the preset brightness value, when the edge sub-pixel displays at the optimized brightness value, the display brightness of the edge sub-pixel can be reduced. In this way, the edge display can be blurred, thereby weakening the edge saw-tooth phenomenon of the edge sub-pixel, and optimizing the display effect of the display screen.

In an embodiment, the light-emitting region of the edge sub-pixel is a region corresponding to the light-emitting structure of the edge sub-pixel, and an area of the light-emitting region of the edge sub-pixel is an area of a projection of the light-emitting structure of the edge sub-pixel on an array substrate of the display screen.

In another embodiment, when the sub-pixel of the display screen is in a fully transparent structure, the light-emitting region of the edge sub-pixel is the region corresponding to the light-emitting structure of the edge sub-pixel, and the area of the light-emitting region of the edge sub-pixel is the area of the projection of the light-emitting structure of the edge sub-pixel on the array substrate of the display screen. Alternatively, the light-emitting region of the edge sub-pixel is a region corresponding to an overall structure of the edge sub-pixel, and the area of the light-emitting region of the edge sub-pixel is an area of a projection of the overall structure of the edge sub-pixel on the array substrate of the display screen.

In an embodiment, the light-emitting region of the edge sub-pixel is a rectangular region defined by four vertices a first vertex farthest from the center of the circle, a second vertex closest to the center of the circle, a third vertex and a fourth vertex. A line connecting the first vertex and the center of the circle is a first radius, a line connecting the second vertex and the center of the circle is a second radius, a line connecting the third vertex and the center of the circle is a third radius, and a line connecting the fourth vertex and the center of the circle is a fourth radius. An angle between the third radius and the fourth radius is a central angle. A circle with a radius of the first radius around the center of the circular arc cutting line is an outer circle, a sector of the outer circle corresponding to the central angle is a first sector, a sector of the circle corresponding to the central angle is a second sector, a circle with a radius of second radius around the center of the circular arc cutting line is an inner circle, and a sector of the inner circle corresponding to the central angle is a third sector. That is, the first sector has an area larger than that of the second sector, and the second sector has an area larger than that of the third sector.

In this embodiment, the first region of the edge sub-pixel is located on a side of the circular arc cutting line facing towards the center of the circle. The area of the first region is equal to the area of an overlap between the edge sub-pixel and the second sector. The area of the light-emitting region of the edge sub-pixel is equal to an area of the overlap between the edge sub-pixel and the first sector.

In an embodiment, when the computer program is executed by the processor, the processor is caused to perform the following steps: calculating a distance between the first vertex and the center of the circle based on the coordinate values of the first vertex and the coordinate values of the center of the circle, to obtain a farthest distance, and calculating a distance between the second vertex and the center of the circle based on the coordinate values of the second vertex and the coordinate values of the center of the circle, to obtain a closest distance; obtaining a first removal area and a second removal area according to the farthest distance, the closest distance, the radius of the circle, and a preset theoretical pixel area; calculating the area of the first region according to the radius of the circle, the closest distance, the central angle, and the first removal area; calculating the area of the light-emitting region of the edge sub-pixel according to the farthest distance, the closest distance, the central angle, the first removal area, and the second removal area; and calculating the ratio of the area of the first region to the area of the light-emitting region of the edge sub-pixel, to obtain the area ratio coefficient of the edge sub-pixel.

The first removal area is an area of a remaining region obtained by removing the overlap between the edge sub-pixel and the second sector, and removing the third sector from the second sector, and the second removal area is an area of a remaining region obtained by removing a region of the edge sub-pixel outside the second sector, and removing the second sector from the first sector. The theoretical pixel area is an area of the light-emitting region of the edge sub-pixel without being cut.

The area ratio coefficient can be obtained according to the ratio of the area of the first region located on the side of the circular arc cutting line facing towards the center of the circle to the area of the light-emitting region of the edge sub-pixel, and the area ratio coefficient can represent the area occupied by a portion of the edge sub-pixel located in the display region. If the area ratio coefficient is different, the optimized brightness value is different. The brightness of the edge sub-pixel display is adjusted depending on the area of the portion of the edge sub-pixel located in the display region, and the edge display has a good blur effect. Thus, the edge saw-tooth phenomenon is reduced significantly.

In an embodiment, when the computer program is executed by the processor, the processor is also caused to perform the following steps:

if $R1+R2>2R$, $S1$ ranging from $2/8*S0$ to $4/8*S0$, and $S2$ ranging from $4/8*S0$ to $6/8*S0$, both including endpoint values;

if $R1+R2=2R$, $S1$ ranging from $3/8*S0$ to $5/8*S0$, and $S2$ ranging from $3/8*S0$ to $5/8*S0$, both including endpoint values; and if $R1+R2<2R$, $S1$ ranging from $4/8*S0$ to $6/8*S0$, and $S2$ ranging from $2/8*S0$ to $4/8*S0$, both including endpoint values, where S1+S2=S0, R2 is the farthest distance, R1 is the closest distance, R is the radius of the circle where the circular arc cutting line is located, S1 is the first removal area, S2 is the second removal area, and S0 is the theoretical pixel area.

By comparing the sum of the farthest distance and the closest distance with twice the radius of the circle where the circular arc cutting line is located, and determining the value of the first removal area and the value of the second removal area according to the result of the comparison, a method for determining the values of the first removal area and the second removal area is provided. Since the values of the first removal area and the second removal area vary with different situations, the accuracy of determining the values may be high by analyzing different situations, thereby increasing the accuracy of the area ratio coefficient and the optimized brightness value, and optimizing the weakening effect on the edge saw-tooth phenomenon.

In an embodiment, when the computer program is executed by the processor, the processor is also caused to perform the following steps:

if $R1+R2>2R$, $S1=3/8*S0$, and $S2=5/8*S0$;

if $R1+R2=2R$, $S1=S2=1/2*S0$; and if $R1+R2<2R$, $S1=5/8*S0$, $S2=3/8*S0$.

In the three cases above, the corresponding values in the embodiment is adopted for the first removal area and the second removal area. In this way, the error is small, and the accuracy of the area ratio coefficient is higher.

In an embodiment, when the computer program is executed by the processor, the processor is also caused to perform the following steps: calculating the area of the second sector and the area of the third sector based on the radius of the circle where the circular arc cutting line is located, the closest distance, and the central angle, and calculating the area of the first region by subtracting the area of the third sector and the first removal area from the area of the second sector; and calculating the area of the first sector and the area of the third sector according to the farthest distance, the closest distance, and the central angle, and calculating the area of the light-emitting region of the edge sub-pixel by subtracting the area of the third sector, the first removal area and the second removal area from the area of the first sector. Specifically, when the computer program is executed by the processor, the processor is also caused to perform the following calculation:

$$A=\pi(R^2-R1^2)*\theta/2\pi-S1, \text{ and}$$

$$B=\pi(R2^2-R1^2)*\theta/2\pi-S1-S2,$$

where R is the radius of the circle where the circular arc cutting line is located, R1 is the closest distance, R2 is the farthest distance, θ is the central angle, S1 is the first removal area, S2 is the second removal area, A is the area of the first region, and B is the area of the light-emitting region of the edge sub-pixel.

The area of the first region is obtained by subtracting the excess area (the first removal area) from the calculated sector area, and the area of the light-emitting region is obtained by subtracting the excess area (the first removal area and the second removal area) from the calculated sector area. This calculation can have a small error, and a relatively accurate area ratio coefficient can be obtained, thereby improving the accuracy of the optimized brightness value, and further optimizing the weakening effect on the edge saw-tooth phenomenon.

It can be understood that in other embodiments, other methods may be employed to obtain the area of the first region and the area of the light-emitting region of the edge sub-pixel.

In another embodiment, when the computer program is executed by the processor, the processor is also caused to perform the following steps: calculating an area of the second region and the area of the light-emitting region of the edge sub-pixel according to the coordinate values of each vertex, the coordinate values of the center of the circle, and the radius of the circle; calculating a ratio of the area of the second region to the area of the light-emitting region of the edge sub-pixel; and calculating the area ratio coefficient of the edge sub-pixel according to the ratio of the area of the second region to the area of the light-emitting region of the edge sub-pixel. Specifically, by subtracting the ratio of the area of the second region to the area of the light-emitting region of the edge sub-pixel from one, the area ratio coefficient of the edge sub-pixel may be obtained.

In an embodiment, when the computer program is executed by the processor, the processor is also caused to perform the following calculation:

$$Lnew=\alpha*Lold,$$

where α is the area ratio coefficient, Lold is the preset brightness value, and Lnew is the optimized brightness value.

By multiplying the preset brightness value by an area ratio coefficient which is less than 1, the preset brightness value is adjusted, and the obtained optimized brightness value is less than the preset brightness value, so that the edge sub-pixel displays at the optimized brightness value, and the brightness is lowered. In this way, the edge display can be blurred, the edge saw-tooth phenomenon of the edge sub-pixel can be weakened, and the display effect of the display screen can be optimized.

The present disclosure also provides a display apparatus, including a display screen and any one of the control devices described above, the control device being connected to the display screen. The control device controls the display brightness of a corresponding edge sub-pixel according to the optimized brightness value of the edge sub-pixel.

Similarly, since the display apparatus includes any one of the above control devices, the edge display can be blurred, thereby reducing edge saw-tooth of the edge sub-pixel and optimizing the display effect of the display screen.

A person of ordinary skill in the art can understand that all or a part of processes in the method according to the embodiments may be implemented by a computer program instructing relevant hardware. The computer program may be stored in a non-transitory computer readable storage medium. When the computer program is executed, the processes of the method according to the embodiments are performed. Any reference to a memory, storage, database or other mediums used in the embodiments provided herein may include a non-volatile and/or volatile memory. The non-volatile memory may include a read only memory (ROM), a programmable ROM (PROM), an electrically programmable ROM (EPROM), an electrically erasable programmable ROM (EEPROM), or a flash memory. The volatile memory may include a random access memory (RAM) or an external cache memory. By way of illustration and not limitation, RAM is available in a variety of forms, such as static RAM (SRAM), dynamic RAM (DRAM), synchronous DRAM (SDRAM), double data rate SDRAM (DDRSDRAM), enhanced SDRAM (ESDRAM), synchronization link DRAM (SLDRAM), rambus direct RANI (RDRAM), direct rambus dynamic RAM (DRDRAM), and rambus dynamic RAM (RDRAM).

Technical features of the above embodiments may be combined arbitrarily. For brief of description, not all possible combinations of the technical features in the above embodiments are described. However, as long as the combinations of the technical features are not contradicted, the combinations should be considered as belonging to the scope of the present disclosure.

The above described embodiments are merely illustrative of several implementations of the present disclosure, and their description is specific and detailed, but cannot therefore be understood as a limitation to the scope of the present disclosure. It should be noted that a person of ordinary skill in the art may make some variations and modifications without departing from the concept of the present application, and the variations and modifications belong to the protection scope of the present disclosure. Therefore, the protection scope of the present disclosure should be subject to the appended claims.

The invention claimed is:

1. A method for controlling edge display of a display screen, comprising:

determining an irregular-shaped cutting line, the irregular-shaped cutting line being located at an irregular-shaped edge of the display screen for defining a theoretical irregular-shaped edge of a display region of the display screen, the irregular-shaped cutting line cutting at least a part of edge sub-pixels of the display screen, a light-emitting region of each of the edge sub-pixels passed through by the irregular-shaped cutting line being divided into a first region located on a side of the irregular-shaped cutting line facing towards the display region of the display screen, and a second region located on another side of the irregular-shaped cutting line facing away from the display region of the display screen;

obtaining coordinate values of each vertex of the edge sub-pixel, and coordinate values of a intersection point of the edge sub-pixel and the irregular-shaped cutting line in a two-dimensional coordinate system of a plane of sub-pixels of the display screen, the coordinate values of the vertex being coordinate values of a common endpoint of adjacent sides of the light-emitting region of the edge sub-pixel;

calculating an area ratio coefficient of each of the edge sub-pixels according to the coordinate values of each vertex and the coordinate values of the intersection point, the area ratio coefficient being a ratio of an area of the first region of the edge sub-pixel to an area of the light-emitting region of the edge sub-pixel, obtaining an optimized brightness value less than a preset brightness value of the edge sub-pixel according to the area ratio coefficient and the preset brightness value; and causing the edge sub-pixel to display at the optimized brightness value;

wherein:

the light-emitting region of the edge sub-pixel is a rectangular region defined by four vertices comprising a first vertex, a second vertex, a third vertex, and a fourth vertex connected sequentially, and the two-dimensional coordinate system of the plane of the sub-pixels of the display screen has a horizontal axis in an extension direction of a side connecting the first vertex and the second vertex, and a vertical axis in an extension direction of a side connecting the first vertex and the fourth vertex;

the coordinate values of the intersection point comprises coordinate values of a first intersection point and coordinate values of a second intersection point;

the area of the first region is an area of a region in the rectangular region of the edge sub-pixel on a side of a line connecting the first intersection point and the second intersection point facing towards the display region of the display screen;

the first intersection point is located on a side connecting the first vertex and the fourth vertex, the second intersection point is located on a side connecting the second vertex and the third vertex, the first region is a trapezoidal region defined by the first intersection point, the second intersection point, the third vertex and the fourth vertex, and according to the coordinate values of each vertex and the coordinate values of the intersection points, the area ratio coefficient of the edge sub-pixel is calculated as follows:

$$S'=(|y4-ya|+|y3-yb|)*|x3-x4|/2,$$

$$S=|x2-x1|*|y3-y2|, \text{ and}$$

$$\alpha=S'/S,$$

wherein x1 is a horizontal coordinate value of the first vertex, x2 is a horizontal coordinate value of the second vertex, x3 is a horizontal coordinate value of the third vertex, x4 is a horizontal coordinate value of the fourth vertex, y2 is a vertical coordinate value of the second vertex, y3 is a vertical coordinate value of the third vertex, y4 is a vertical coordinate value of the fourth vertex, ya is a vertical coordinate value of the first intersection point, yb is a vertical coordinate value of the second intersection point, S' is the area of the first region, S is the area of the light-emitting region, and α is the area ratio coefficient;

or, the first intersection point is located on a side connecting the third vertex and the fourth vertex, and the second intersection point is located on the side connecting the second vertex and the third vertex, the first region is a triangular region defined by the first intersection point, the second intersection point, and the third vertex, and according to the coordinate values of each vertex and the coordinate values of the intersection points, the area ratio coefficient of the edge sub-pixel is calculated as follows:

$$S'=(|y3-yb|*|x3-xa|)/2,$$

$$S=|x2-x1|*|y3-y2|, \text{ and}$$

$$\alpha=S'/S,$$

wherein x1 is a horizontal coordinate value of the first vertex, x2 is the horizontal coordinate value of the second vertex, x3 is the horizontal coordinate value of the third vertex, y2 is the vertical coordinate value of the second vertex, y3 is the vertical coordinate value of the third vertex, xa is a horizontal coordinate value of the first intersection point, yb is the vertical coordinate value of the second intersection point, S' is the area of the first region, S is the area of the light-emitting region, and α is the area ratio coefficient; and or, the first intersection point is located on the side connecting the first vertex and the fourth vertex, the second intersection point is located on a side connecting the first vertex and the second vertex, the first region is a triangular region defined by the first intersection point, the second intersection point, and the first vertex, and according to the coordinate values of each vertex and the coordinate values of the intersection points, the area ratio coefficient of the edge sub-pixel is calculated as follows:

$$S'=(|ya-y1|*|xb-x1|)/2,$$

$$S=|x2-x1|*|y3-y2|, \text{ and}$$

$$\alpha=S'/S,$$

wherein x1 is the horizontal coordinate value of the first vertex, x2 is the horizontal coordinate value of the second vertex, y1 is a vertical coordinate value of the first vertex, y2 is the vertical coordinate value of the second vertex, y3 is the vertical coordinate value of the third vertex, ya is the vertical coordinate value of the first intersection point, xb is a horizontal coordinate value of the second intersection point, S' is the area of the first region, S is the area of the light-emitting region, and α is the area ratio coefficient.

2. The method of claim 1, wherein the light-emitting region of the edge sub-pixel is a region corresponding to a light-emitting structure of the edge sub-pixel, and an area of the light-emitting region of the edge sub-pixel is an area of a projection of the light-emitting structure of the edge sub-pixel on an array substrate of the display screen.

3. The method of claim 1, wherein the light-emitting region of the edge sub-pixel is a region corresponding to an overall structure of the edge sub-pixel, and the area of the light-emitting region of the edge sub-pixel is an area of a projection of the overall structure of the edge sub-pixel on an array substrate of the display screen.

4. The method of claim 1, wherein the obtaining the coordinate values of each vertex of the edge sub-pixel, and the coordinate values of the intersection point of the edge sub-pixel and the irregular-shaped cutting line in the two-dimensional coordinate system of the plane of the sub-pixels of the display screen comprises:

obtaining the coordinate values of each vertex of the edge sub-pixel in the two-dimensional coordinate system of the plane of the sub-pixels of the display screen, and a curve analytic equation of the irregular-shaped cutting line in the same two-dimensional coordinate system; and calculating the coordinate values of the intersection point of the edge sub-pixel and the irregular-shaped cutting line according to the coordinate values of the vertex and the curve analytic equation.

5. The method of claim 4, wherein the calculating the coordinate values of the intersection point of the edge sub-pixel and the irregular-shaped cutting line according to the coordinate values of the vertex and the curve analytic equation comprises:

obtaining an analytic equation of a side of the edge sub-pixel intersecting with the irregular-shaped cutting line according to the coordinate values of the vertex; and establishing and solving an equation set of the curve analytic equation and the analytic equation of the side of the edge sub-pixel intersecting with the irregular-shaped cutting line, to obtain the coordinate values of the intersection point of the edge sub-pixel and the irregular-shaped cutting line.

6. The method of claim 1, wherein the calculating the area ratio coefficient of the edge sub-pixels according to the coordinate values of each vertex and the coordinate values of the intersection point comprises:

calculating an area of the second region and the area of the light-emitting region of the edge sub-pixel according to the coordinate values of each vertex and the coordinate values of the intersection point;

calculating a ratio of the area of the second region to the area of the light-emitting region of the edge sub-pixel; and calculating the area ratio coefficient of the edge sub-pixel according to the ratio of the area of the second region to the area of the light-emitting region of the edge sub-pixel.

7. The method of claim 1, wherein the obtaining the optimized brightness value less than the preset brightness value of the edge sub-pixel according to the area ratio coefficient and the preset brightness value comprises:

$$Lnew=\alpha*Lold,$$

wherein α is the area ratio coefficient, Lold is the preset brightness value, and Lnew is the optimized brightness value.

8. The method of claim 1, wherein: the light-emitting region of the edge sub-pixel is a region corresponding to a light-emitting structure of the edge sub-pixel, an area of the light-emitting region of the edge sub-pixel is an area of a projection of the light-emitting structure of the edge sub-pixel on an array substrate of the display screen; and or, the light-emitting region of the edge sub-pixel is a region corresponding to an overall structure of the edge sub-pixel, and the area of the light-emitting region of the edge sub-pixel is an area of a projection of the overall structure of the edge sub-pixel on the array substrate of the display screen.

9. A method for controlling edge display of a display screen, comprising:

determining an irregular-shaped cutting line, the irregular-shaped cutting line being located at an irregular-shaped edge of the display screen for defining a theoretical irregular-shaped edge of a display region of the display screen, the irregular-shaped cutting line cutting at least a part of edge sub-pixels of the display screen, a light-emitting region of each of the edge sub-pixels passed through by the irregular-shaped cutting line being divided into a first region located on a side of the irregular-shaped cutting line facing towards the display region of the display screen, and a second region located on another side of the irregular-shaped cutting line facing away from the display region of the display screen;

obtaining coordinate values of each vertex of the edge sub-pixel, and coordinate values of a intersection point of the edge sub-pixel and the irregular-shaped cutting line in a two-dimensional coordinate system of a plane of sub-pixels of the display screen, the coordinate values of the vertex being coordinate values of a common endpoint of adjacent sides of the light-emitting region of the edge sub-pixel;

calculating an area ratio coefficient of each of the edge sub-pixels according to the coordinate values of each vertex and the coordinate values of the intersection point, the area ratio coefficient being a ratio of an area of the first region of the edge sub-pixel to an area of the light-emitting region of the edge sub-pixel, the area ratio being calculated by applying a predetermined Bezier curve fitting analytical equation or a predetermined analytical equation associated with a radius of the circle where the irregular-shaped cutting line is located;

obtaining an optimized brightness value less than a preset brightness value of the edge sub-pixel according to the area ratio coefficient and the preset brightness value; and causing the edge sub-pixel to display at the optimized brightness value;

wherein:

the light-emitting region of the edge sub-pixel is a rectangular region defined by four vertices comprising a first vertex, a second vertex, a third vertex, and a fourth vertex connected sequentially, and the two-dimensional coordinate system of the plane of the sub-pixels of the display screen has a horizontal axis in an extension direction of a side connecting the first vertex and the second vertex, and a vertical axis in an extension direction of a side connecting the first vertex and the fourth vertex;

the coordinate values of the intersection point comprises coordinate values of a first intersection point and coordinate values of a second intersection point;

the area of the first region is an area of a region in the rectangular region of the edge sub-pixel on a side of a line connecting the first intersection point and the second intersection point facing towards the display region of the display screen;

the first intersection point is located on a side connecting the first vertex and the fourth vertex, the second intersection point is located on a side connecting the second vertex and the third vertex, the first region is a trapezoidal region defined by the first intersection point, the second intersection point, the third vertex and the fourth vertex, and according to the coordinate values of each vertex and the coordinate values of the intersection points, the area ratio coefficient of the edge sub-pixel is calculated as follows:

$$S'=(|y4-ya|+|y3-yb|)*|x3-x4|/2,$$

$$S=|x2-x1|*|y3-y2|, \text{ and}$$

$$\alpha=S'/S,$$

wherein x1 is a horizontal coordinate value of the first vertex, x2 is a horizontal coordinate value of the second vertex, x3 is a horizontal coordinate value of the third vertex, x4 is a horizontal coordinate value of the fourth vertex, y2 is a vertical coordinate value of the second vertex, y3 is a vertical coordinate value of the third vertex, y4 is a vertical coordinate value of the fourth vertex, ya is a vertical coordinate value of the first intersection point, yb is a vertical coordinate value of the second intersection point, S' is the area of the first region, S is the area of the light-emitting region, and α is the area ratio coefficient;

or, the first intersection point is located on a side connecting the third vertex and the fourth vertex, and the second intersection point is located on the side connecting the second vertex and the third vertex, the first region is a triangular region defined by the first intersection point, the second intersection point, and the third vertex, and according to the coordinate values of each vertex and the coordinate values of the intersection points, the area ratio coefficient of the edge sub-pixel is calculated as follows:

$$S'=(|y3-yb|*|x3-xa|)/2,$$

$$S=|x2-x1|*|y3-y2|, \text{ and}$$

$$\alpha=S'/S,$$

wherein x1 is a horizontal coordinate value of the first vertex, x2 is the horizontal coordinate value of the second vertex, x3 is the horizontal coordinate value of the third vertex, y2 is the vertical coordinate value of the second vertex, y3 is the vertical coordinate value of the third vertex, xa is a horizontal coordinate value of the first intersection point, yb is the vertical coordinate value of the second intersection point, S' is the area of the first region, S is the area of the light-emitting region, and α is the area ratio coefficient; and or, the first intersection point is located on the side connecting the first vertex and the fourth vertex, the second intersection point is located on a side connecting the first vertex and the second vertex, the first region is a triangular region defined by the first intersection point, the second intersection point, and the first vertex, and according to the coordinate values of each vertex and the coordinate values of the intersection points, the area ratio coefficient of the edge sub-pixel is calculated as follows:

$$S'=(|ya-y1|*|xb-x1|)/2,$$

$$S=|x2-x1|*|y3-y2|, \text{ and}$$

$$\alpha=S'/S,$$

wherein x1 is the horizontal coordinate value of the first vertex, x2 is the horizontal coordinate value of the second vertex, y1 is a vertical coordinate value of the first vertex, y2 is the vertical coordinate value of the second vertex, y3 is the vertical coordinate value of the third vertex, ya is the vertical coordinate value of the first intersection point, xb is a horizontal coordinate value of the second intersection point, S' is the area of the first region, S is the area of the light-emitting region, and $\alpha$ is the area ratio coefficient.

10. A method for controlling edge display of a display screen, comprising:

determining an irregular-shaped cutting line, the irregular-shaped cutting line being located at an irregular-shaped edge of the display screen for defining a theoretical irregular-shaped edge of a display region of the display screen, the irregular-shaped cutting line cutting at least a part of edge sub-pixels of the display screen, a light-emitting region of each of the edge sub-pixels passed through by the irregular-shaped cutting line being divided into a first region located on a side of the irregular-shaped cutting line facing towards the display region of the display screen, and a second region located on another side of the irregular-shaped cutting line facing away from the display region of the display screen;

obtaining coordinate values of each vertex of the edge sub-pixel, and coordinate values of a intersection point of the edge sub-pixel and the irregular-shaped cutting line in a two-dimensional coordinate system of a plane of sub-pixels of the display screen, the coordinate values of the vertex being coordinate values of a common endpoint of adjacent sides of the light-emitting region of the edge sub-pixel;

calculating an area ratio coefficient of each of the edge sub-pixels according to the coordinate values of each vertex and the coordinate values of the intersection point, the area ratio coefficient being a ratio of an area of the first region of the edge sub-pixel to an area of the light-emitting region of the edge sub-pixel;

obtaining an optimized brightness value less than a preset brightness value of the edge sub-pixel according to the area ratio coefficient and the preset brightness value; and causing the edge sub-pixel to display at the optimized brightness value;

wherein:

the light-emitting region of the edge sub-pixel is a rectangular region defined by four vertices comprising a first vertex farthest from the center of the circle, a second vertex closest to the center of the circle, a third vertex and a fourth vertex, a line connecting the first vertex and the center of the circle is a first radius, a line connecting the second vertex and the center of the circle is a second radius, a line connecting the third vertex and the center of the circle is a third radius, a line connecting the fourth vertex and the center of the circle is a fourth radius, and an angle between the third radius and the fourth radius is a central angle;

a circle with a radius of the first radius around the center of the circular arc cutting line is an outer circle, a sector of the outer circle corresponding to the central angle is a first sector, a sector of the circle corresponding to the central angle is a second sector, a circle with a radius of second radius around the center of the circular arc cutting line is an inner circle, and a sector of the inner circle corresponding to the central angle is a third sector;

the first region is located on a side of the circular arc cutting line facing towards the center of the circle, the area of the first region is equal to an area of an overlap between the edge sub-pixel and the second sector, and the area of the light-emitting region of the edge sub-pixel is equal to an area of an overlap between the edge sub-pixel and the first sector;

the calculating the area ratio coefficient of the edge sub-pixel according to the coordinate values of each vertex, the coordinate values of the center of the circle, and the radius of the circle comprises:

calculating a distance between the first vertex and the center of the circle based on the coordinate values of the first vertex and the coordinate values of the center of the circle, to obtain a farthest distance, and calculating a distance between the second vertex and the center of the circle based on the coordinate values of the second vertex and the coordinate values of the center of the circle, to obtain a closest distance;

obtaining a first removal area and a second removal area according to the farthest distance, the closest distance, the radius of the circle, and a preset theoretical pixel area, the first removal area being an area of a remaining region obtained by removing the overlap between the edge sub-pixel and the second sector, and removing the third sector from the second sector, and the second removal area being an area of a remaining region obtained by removing a region of the edge sub-pixel outside the second sector, and removing the second sector from the first sector;

calculating the area of the first region according to the radius of the circle, the closest distance, the central angle, and the first removal area;

calculating the area of the light-emitting region of the edge sub-pixel according to the farthest distance, the closest distance, the central angle, the first removal area, and the second removal area; and calculating the ratio of the area of the first region to the area of the light-emitting region of the edge sub-pixel, to obtain the area ratio coefficient of the edge sub-pixel.

11. The method of claim 10, wherein the calculating the area of the first region according to the radius of the circle, the closest distance, the central angle, and the first removal area comprises $$A=\pi(R^2-R1^2)*\theta/2\pi-S1,$$

the calculating the area of the light-emitting region of the edge sub-pixel according to the farthest distance, the closest distance, the central angle, the first removal area, and the second removal area comprises $$B=\pi(R2^2-R1^2)*\theta/2\pi-S1-S2,$$

where R is the radius of the circle, R1 is the closest distance, R2 is the farthest distance, 0 is the central angle, S1 is the first removal area, S2 is the second removal area, A is the area of the first region, and B is the area of the light-emitting region of the edge sub-pixel.

12. The method of claim 11, wherein the obtaining the first removal area and the second removal area according to the farthest distance, the closest distance, the radius of the circle, and the preset theoretical pixel area comprises:

$S1$ ranging from $2/8*S0$ to $4/8*S0$, and $S2$ ranging from $4/8*S0$ to $6/8*S0$, if $R1+R2>2R$;

$S1$ ranging from $3/8*S0$ to $5/8*S0$, and $S2$ ranging from $3/8*S0$ to $5/8*S0$, if $R1+R2=2R$; and $S1$ ranging from $4/8*S0$ to $6/8*S0$, and $S2$ ranging from $2/8*S0$ to $4/8*S0$, if $R1+R2<2R$, wherein S1+S2=S0, R2 is the farthest distance, R1 is the closest distance, R is the radius of the circle, S1 is the first removal area, S2 is the second removal area, and S0 is the theoretical pixel area.

13. The method of claim 12, wherein the obtaining the first removal area and the second removal area according to the farthest distance, the closest distance, the radius of the circle, and the preset theoretical pixel area comprises:

$S1=3/8*S0$, and $S2=5/8*S0$, if $R1+R2>2R$;

$S1=S2=1/2*S0$, if $R1+R2=2R$; and $S1=5/8*S0$, and $S2=3/8*S0$, if $R1+R2<2R$.

14. The method of claim 10, wherein the calculating the area ratio coefficient of the edge sub-pixel according to the coordinate values of each vertex, the coordinate values of the center of the circle, and the radius of the circle comprises:

calculating an area of the second region and the area of the light-emitting region of the edge sub-pixel according to the coordinate values of each vertex, the coordinate values of the center of the circle, and the radius of the circle;

calculating a ratio of the area of the second region to the area of the light-emitting region of the edge sub-pixel; and calculating the area ratio coefficient of the edge sub-pixel according to the ratio of the area of the second region to the area of the light-emitting region of the edge sub-pixel.

15. The method of claim 10, wherein the obtaining an optimized brightness value less than the preset brightness value of the edge sub-pixel according to the area ratio coefficient and the preset brightness value comprises $Lnew=\alpha*Lold$, where $\alpha$ is the area ratio coefficient, Lold is the preset brightness value, and Lnew is the optimized brightness value.

* * * * *